US007501382B2

(12) United States Patent
Foster et al.

(10) Patent No.: US 7,501,382 B2
(45) **Date of Patent: *Mar. 10, 2009**

(54) SLIPPING LAYER FOR DYE-DONOR ELEMENT USED IN THERMAL DYE TRANSFER

(75) Inventors: David G. Foster, West Henrietta, NY (US); William B. Vreeland, Webster, NY (US); Richard P. Henzel, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 288 days.

This patent is subject to a terminal disclaimer.

(21) Appl. No.: 11/406,178

(22) Filed: Apr. 18, 2006

(65) Prior Publication Data

US 2006/0189482 A1 Aug. 24, 2006

Related U.S. Application Data

(63) Continuation-in-part of application No. 10/614,379, filed on Jul. 7, 2003, now Pat. No. 7,078,366, and a continuation-in-part of application No. 11/315,416, filed on Dec. 22, 2005, now Pat. No. 7,160,664.

(51) Int. Cl.
*B41M 5/035* (2006.01)
*B41M 5/39* (2006.01)

(52) U.S. Cl. ..... 503/227; 428/32.64; 428/32.65; 428/32.66; 428/32.67; 428/32.68

(58) Field of Classification Search ..... None
See application file for complete search history.

(56) References Cited

U.S. PATENT DOCUMENTS 4,621,271 A 11/1986 Brownstein (Continued)

FOREIGN PATENT DOCUMENTS

EP 1 205 313 A1 5/2002

(Continued)

*Primary Examiner*—Bruce H Hess
(74) *Attorney, Agent, or Firm*—Lynne M. Blank; Kathleen Neuner Manne

(57) ABSTRACT

The present invention relates to a dye-donor element for thermal dye transfer comprising a support having on one side a dye layer and on a second side a slipping layer, wherein the slipping layer comprises a first wax comprising a polymer derived from a polyolefin and an ethylenically unsaturated carboxylic acid or ester or anhydride thereof, and at least one other wax and wherein the dye layer comprises at least a magenta dye of the Structure I:

(I)

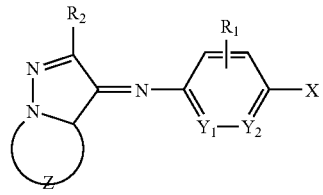

wherein the dye donor element has reduced 2× retransfer. The present invention also relates to the same slip layer with a dye layer comprising at least a yellow dye of the Structure X:

(X)

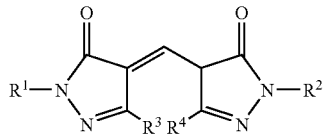

or Structure XI:

(XI)

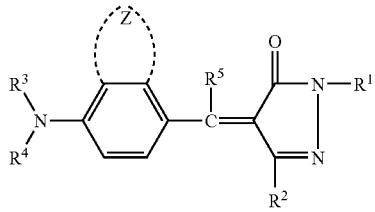

or Structure XII:

(XII)

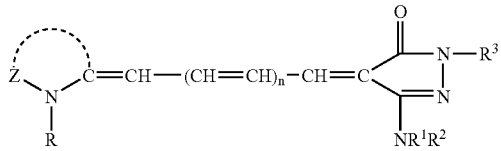

or Structure XIII:

(XIII)

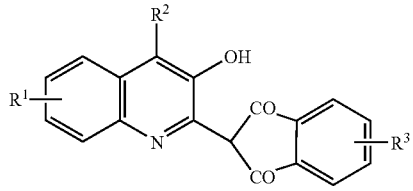

or wherein the dye layer comprises at least a cyan dye of Structure XX:

(XX)

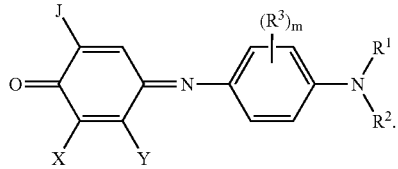

48 Claims, No Drawings

U.S. PATENT DOCUMENTS

| | | | | |
|---|---|---|---|---|
| 4,686,549 | A | 8/1987 | Williams et al. | |
| 4,839,336 | A | 6/1989 | Evans et al. | |
| 4,866,026 | A | 9/1989 | Henzel et al. | |
| 4,898,751 | A | 2/1990 | Dwivedy | |
| 4,910,087 | A | 3/1990 | Torii et al. | |
| 4,916,112 | A | 4/1990 | Henzel et al. | |
| RE33,819 | E | 2/1992 | Moore et al. | |
| 5,300,475 | A | 4/1994 | Takuma et al. | |
| 5,476,943 | A | 12/1995 | Komamura et al. | |
| 5,532,202 | A | 7/1996 | Yoshida | |
| 5,612,282 | A | 3/1997 | Komamura et al. | |
| 5,627,130 | A | 5/1997 | Bailey et al. | |
| 5,939,207 | A | 8/1999 | Fensore et al. | |
| 5,965,485 | A | 10/1999 | Mizumachi et al. | |
| 6,103,042 | A | 8/2000 | Henzel et al. | |
| 6,866,706 | B2 | 3/2005 | Ishida et al. | |
| 7,078,366 | B2 * | 7/2006 | Foster et al. | 503/227 |
| 7,160,664 | B1 * | 1/2007 | Goswami et al. | 430/201 |
| 2002/0044192 | A1 | 4/2002 | Hirano | |
| 2005/0009698 | A1 | 1/2005 | Foster et al. | |
| 2005/0227023 | A1 | 10/2005 | Araki et al. | |

FOREIGN PATENT DOCUMENTS

| | | |
|---|---|---|
| JP | 02069292 | 3/1990 |
| JP | 09300827 | 11/1997 |
| JP | 11291645 | 10/1999 |
| JP | 11301125 | 11/1999 |
| JP | 2000225775 | 8/2000 |
| JP | 2000229483 | 8/2000 |
| JP | 2002011967 | 1/2002 |

* cited by examiner

SLIPPING LAYER FOR DYE-DONOR ELEMENT USED IN THERMAL DYE TRANSFER

CROSS REFERENCE TO RELATED APPLICATION

This is a continuation-in-part of application Ser. No. 10/614,379, filed Jul. 7, 2003 now U.S. Pat. No. 7,078,366, entitled "SLIPPING LAYER CONTAINING WAX MIXTURE FOR DYE-DONOR ELEMENT USED IN THERMAL DYE TRANSFER" by Foster et al. and a continuation-in-part of application Ser. No. 11/315,416, filed on Dec. 22, 2005 now U.S. Pat. No. 7,160,664, entitled "MAGENTA DYE MIXTURE" by Goswami et al.

FIELD OF THE INVENTION

This invention relates to dye donor elements used in thermal dye transfer, and more particularly to the use of a blend of waxes in the slipping layer on the back side thereof in combination with dyes to improve the retransfer performance of the donor element.

BACKGROUND OF THE INVENTION

Thermal transfer systems have been developed to obtain prints from pictures that have been generated electronically, for example, from a color video camera or digital camera. An electronic picture can be subjected to color separation by color filters. The respective color-separated images can be converted into electrical signals. These signals can be operated on to produce cyan, magenta, and yellow electrical signals. These signals can be transmitted to a thermal printer. To obtain a print, a black, cyan, magenta, or yellow dye-donor layer, for example, can be placed face-to-face with a dye image-receiving layer of a receiver element to form a print assembly, which can be inserted between a thermal print head and a platen roller. A thermal print head can be used to apply heat from the back of the dye-donor sheet. The thermal print head can be heated up sequentially in response to the black, cyan, magenta, or yellow signals. The process can be repeated as needed to print all colors, and a laminate or protective layer, as desired. A color hard copy corresponding to the original picture can be obtained. Further details of this process and an apparatus for carrying it out are contained in U.S. Pat. No. 4,621,271 to Brownstein.

In recent years the need has arisen to increase printing speed to satisfy customer demand. Various approaches have been adopted to achieve a higher printing rate. For example, a higher dye/binder ratio in combination with a reduced printing line-time can achieve satisfactory densities in a high-speed printing operation.

Such higher dye/binder ratios can, however, lead to quality problems following the manufacture of the dye transfer ribbons. When rolls of such ribbons are stored in the wound state, dyes can transfer to the slip layer provided on the back of the transfer sheet. This problem can occur in the manufacturing operation but is exacerbated under the conditions of high temperature and humidity that may occur sporadically in long-distance shipping operations. When such rolls are subsequently rewound into customer formats the transferred dye can be retransferred to the dye and protective layers on the donor sheet. At the time of printing onto an image receiving sheet, such contaminated layers produce colors which are different from those intended. Most objectionable is the noticeable stain in white areas of the print associated with undesirable dye transfer from the clear protective patch. Numerous attempts have been made to address this problem.

JP2000225775 teaches that a slip layer having greater than a specific surface roughness reduces dye transfer to the slip layer. Such increased surface roughness can lead to print head abrasion problems. JP02069292 proposes the use of a specific cyan dye to reduce retransfer but such dyes are not optimum in other respects. JP09300827 teaches the use of phosphate materials and polyvinyl acetal resins in the slip layer composition. JP11301125 proposes the use of a retransfer preventing layer on top of the protective laminate patch, where the resin employed in the retransfer preventing layer is the same as that in the laminate. JP11291645 teaches slip layer compositions comprising polysiloxanes and polyvinylacetal for reduced retransfer.

JP2000229483 proposes a slip layer composed of two sublayers showing reduced coefficient of friction. The outer layer comprises acrylic, polyvinyl or phenoxy resins. JP2002011967 teaches slip layers for reduced transfer problems comprising resin, lubricants and polyisocyanate materials. U.S. Pat. No. 5,965,485 proposes a multilayer protective laminate structure to prevent retransfer of dye from slip layer to laminate which includes a low-dye-affinity top layer in the laminate. US 2005/0227023 teaches the use of dye binder resin comprising styrene-containing polyol resins.

Up till now, satisfactory retransfer properties combined with high speed printing of dyes showing excellent color reproduction and image stability have not been achieved.

Ser. No. 11/315,416 describes a magenta dye combination, a thermal donor including the magenta dye combination, and a method of forming thermal prints using the donor. The magenta dye compositions provide improved light stability and improved keeping properties, such as reduced or no crystallization. The magenta dye compositions further provides a more efficient dye composition, having a higher Dmax at certain voltage and line times.

SUMMARY OF INVENTION

The present invention relates to a dye-donor element for thermal dye transfer comprising a support having on one side a dye layer and on a second side a slipping layer, wherein the slipping layer comprises a first wax comprising a polymer derived from a polyolefin and an ethylenically unsaturated carboxylic acid or ester or anhydride thereof, and at least one other wax and wherein the dye layer comprises at least a magenta dye of the following structure I:

(I)

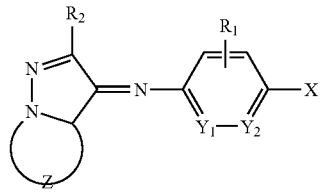

wherein X is a $NR_3R_4$ group or a hydroxyl group, wherein $R_3$ and $R_4$ may be same or different and are independently selected from an alkyl, alkenyl, aryl, aralkyl, or cycloalkyl group; $Y_1$ and $Y_2$ each independently are selected from a carbon atom or a nitrogen atom, provided that one of $Y_1$ and $Y_2$ is a nitrogen atom; Z is an atomic group necessary to form a 5- or 6-membered nitrogen-containing heterocyclic ring which may be condensed with another ring; and $R_1$ and $R_2$ are each independently selected from a hydrogen atom, halogen atom, alkyl, alkenyl, alkoxy, alkylamino, acetamido, sulfonamide, aryl, aralkyl, or cycloalkyl group, wherein the dye donor element has reduced 2× retransfer. The present invention also relates to a dye-donor element for thermal dye transfer comprising a support having on one side a dye layer and on a second side a slipping layer, wherein the slipping layer comprises a first wax comprising a polymer derived from a polyolefin and an ethylenically unsaturated carboxylic acid or ester or anhydride thereof, and at least one other wax and wherein the dye layer comprises at least a yellow dye of the following structure X:

(X)

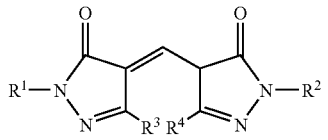

wherein $R^1$ and $R^2$ can be respectively independently selected and are a lower alkyl group which may be substituted, a lower alkenyl group which may be substituted or an aryl group which may be substituted;

$R^3$ and $R^4$ can be respectively independently selected and are a lower alkyl group which may be substituted, a dialkylamino group, a —$COOR^5$ group or a —$CONR^6R^7$ group, in which $R^5$ is a lower alkyl group which may be substituted, a lower alkenyl group which may be substituted or an aryl group which may be substituted and $R^6$ and $R^7$ can be respectively independently selected and are a hydrogen atom, a lower alkyl group which may be substituted, a lower alkenyl group which may be substituted or an aryl group which may be substituted;

or at least a yellow dye of the following structure XI:

(XI)

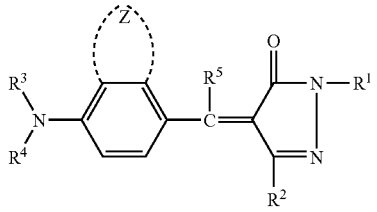

wherein $R^1$ represents a substituted or unsubstituted alkyl group having from 1 to 10 carbon atoms; a cycloalkyl group having from 5 to 7 carbon atoms or an aryl group having from 6 to 10 carbon atoms;

$R^2$ represents a substituted or unsubstituted alkoxy group having from 1 to 10 carbon atoms; a substituted or unsubstituted aryloxy group having from 6 to 10 carbon atoms; $NHR^6$; $NR^6$, $R^7$ or the atoms necessary to complete a 6-membered ring fused to the benzene ring;

$R^3$ and $R^4$ each represents $R^1$; or $R^3$ and $R^4$ can be joined together to form, along with the nitrogen to which they are attached, a 5- or 6-membered hetercyclic ring;

$R^5$ represents hydrogen; halogen; carbamoyl; alkoxycarbonyl; acyl; a substituted or unsubstituted alkyl or alkoxy group having from 1 to 10 carbon atoms; a cycloalkyl group having from 5 to 7 carbon atoms; an aryl group having from 6 to 10 carbon atoms; or a dialkylamino group;

$R^6$ and $R^7$ each independently represents a substituted or unsubstituted alkyl group having from 1 to 10 carbon atoms; a cycloalkyl group having from 5 to 7 carbon atoms or an aryl group having from 6 to 10 carbon atoms; $R^6$ and $R^7$ may be joined together to form, along with the nitrogen to which they are attached, a 5- or 6-membered heterocyclic ring; and Z represents hydrogen or the atoms necessary to complete a 5- or 6-membered ring;

or at least a yellow dye of the following structure XII:

(XII)

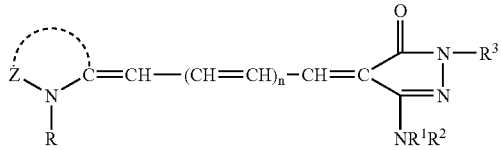

wherein:

R represents a substituted or unsubstituted alkyl group of from 1 to 6 carbon atoms or a substituted or unsubstituted aryl group of from 6 to 10 carbon atoms;

$R^1$ and $R^2$ each independently represents hydrogen, with the proviso that only one of $R^1$ and $R^2$ may be hydrogen at the same time; a substituted or unsubstituted alkyl group of from 1 to 6 carbon atoms or a substituted or unsubstituted aryl group of from 6 to 10 carbon atoms; or $R^1$ and $R^2$ may be combined together with the nitrogen to which they are attached to form a heterocyclic ring system;

$R^3$ is R;

n represents 0 or 1; and

Z represents the atoms necessary to complete a 5- or 6-membered substituted or unsubstituted heterocyclic ring;

or at least a yellow dye of the following structure XIII:

(XIII)

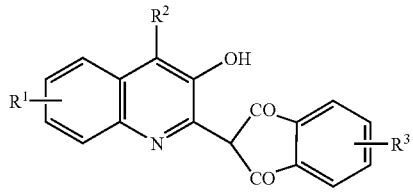

wherein:

$R_1$ is an alkyl group having 1 to 8 carbon atoms or cycloalkyl group;

$R_2$ is a hydrogen atom, halogen atom, alkoxy group which may be substituted, alkylthio group which may be substituted or arylthio group which may be substituted;

$R_3$ is a branched alkyl group having 3 to 5 carbon atoms, an O-substituted oxycarbonyl group, an N-substituted aminocarbonyl group in which the N-substituted group may form a ring, or a substituted or unsubstituted heterocyclic ring having two or more hetero atoms of one or more kinds selected from the group consisting of a nitrogen atom, oxygen atom and sulfur atom; and wherein the dye donor element has reduced 2× retransfer. The present invention also relates to a dye-donor element for thermal dye transfer comprising a support having on one side a dye layer and on a second side a slipping layer, wherein the slipping layer comprises a first wax comprising a polymer derived from a polyolefin and an ethylenically unsaturated carboxylic acid or ester or anhydride thereof, and at least one other wax and wherein the dye layer comprises at least a cyan dye of the following structure XX:

(XX)

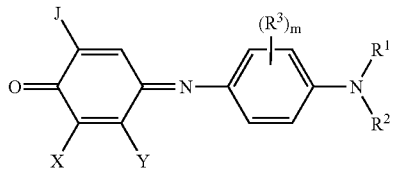

wherein:

$R^1$ and $R^2$ each independently represents hydrogen; an alkyl group having from 1 to 6 carbon atoms; a cycloalkyl group having from 5 to 7 carbon atoms; allyl; or such alkyl, cycloalkyl or allyl groups substituted with one or more groups; each $R^3$ independently represents hydrogen, substituted or unsubstituted alkyl, cycloalkyl or allyl as described above for $R^1$ and $R^2$; alkoxy, aryloxy, halogen, thiocyano, acylamido, ureido, alkylsulfonamido, arylsulfonamido, alkylthio, arylthio or trifluoromethyl; or any two of $R^3$ may be combined together to form a 5- or 6-membered carbocyclic or heterocyclic ring; or one or two of $R^3$ may be combined with either or both of $R^1$ and $R^2$ to complete a 5- to 7-membered ring;

m is an integer of from 0 to 4;

X represents hydrogen, halogen or may be combined together with Y to represent the atoms necessary to complete a 6-membered aromatic ring to form a fused bicyclic quinoneimine;

J represents $NHCOR^4$, $NHCO_2R^4$, $NHCONHR^4$ or $NHSO_2R^4$; and with the proviso that when X is combined with Y, then J represents $CONHR^4$, $SO_2NHR^4$, CN, $SO_2R^4$ or SCN, in which case, however, $R^4$ cannot be hydrogen;

$R^4$ is the same as $R^1$ or represents an aryl group having from 6 to 10 carbon atoms; a hetaryl group having from 5 to 10 atoms; or such aryl or hetaryl groups substituted with one or more groups such as are listed above for $R^1$ and $R^2$; and Y is the same as $R^4$, or acylamino or may be combined together with X as described above; and wherein the dye donor element has reduced 2× retransfer.

DETAILED DESCRIPTION OF THE INVENTION

This invention relates to a dye-donor element for thermal dye transfer comprising a support having on one side thereof a dye layer and on the other side a slipping layer, wherein the slipping layer comprises a first wax comprising a polymer derived from a polyolefin and an ethylenically unsaturated carboxylic acid or ester or anhydride thereof, and at least one other wax. In a preferred embodiment, the slipping layer comprises at least three different waxes: a polymer derived from a polyolefin and an ethylenically unsaturated carboxylic acid or ester or anhydride thereof, a highly branched α-olefin polymer, and at least one other wax.

In particular, the invention relates to a new slipping layer formulation for resistive head thermal media which incorporates a synergistic combination of lubricants from a friction perspective and in terms of headwear or print head buildup. When particular thermal media dyes are combined with the use of the slip layer, dye retransfer is markedly reduced. For purposes of the present invention, 1× retransfer describes the quality problem experienced following the manufacture of the dye transfer ribbons, when rolls of such ribbons are stored in the wound state, and dyes transfer to the slip layer provided on the back of the transfer sheet. For purposes of the present invention, 2× retransfer describes the quality problem experienced following the manufacture of the dye transfer ribbons, when such rolls are subsequently rewound into customer formats and dye previously transferred to the slip layer (1× retransfer) can be retransferred again, this time to the dye and protective layers on the donor sheet. A magenta dye combination comprising at least a first magenta dye of structure I, a second magenta dye of the structure II are particularly useful. Additional magenta dyes can be added to the composition. The slip layer also provides retransfer benefits relating to yellow dyes and dye combinations, as well as cyan dyes and dye combinations. Additional benefits include preventing or reducing folds, especially when used with relatively fast printers, for example at 4 milliseconds or less per line. Finally, the slip layer is capable of being coated at high speed.

The slip layer is coated on a side of the support opposite the dye-donor layer. The slip layer can include a lubricating material, for example, a surface-active agent, a liquid lubricant, a solid lubricant, or mixtures thereof, with or without a polymeric binder. Suitable polymers can include graft copolymers, block polymers, copolymers, and polymer blends or mixtures. Suitable polymeric binders for the slip layer can include poly(vinyl alcohol-co-vinylbutyral), poly (vinyl alcohol-co-vinylacetal), polystyrene, poly(vinyl acetate), cellulose acetate butyrate, cellulose acetate, ethyl cellulose, and other binders as known to practitioners in the art.

The amount of lubricating material used in the slip layer is dependent, at least in part, upon the type of lubricating material, but can be in the range of from 0.001 to 2 g/m$^2$, although less or more lubricating material can be used as needed. If a polymeric binder is used, the lubricating material can be present in a range of 0.1 to 50 weight %, preferably 0.5 to 40 weight %, of the polymeric binder. In one embodiment, the slipping layer comprises 10 to 80 percent by weight of the polymer derived from a polyolefin and an ethylenically unsaturated carboxylic acid or ester or anhydride thereof; 10 to 80 percent by weight of the highly branched α-olefin polymer, and 10 to 80 percent by weight of a substantially linear wax, based on the total weight of the three waxes.

Regarding the first wax, the polymer derived from a polyolefin and an ethylenically unsaturated carboxylic acid or ester or anhydride, suitable polymers include those set forth in U.S. Pat. No. 3,590,076, herein incorporated by reference in its entirety. The number average molecular weight of the polymer is generally from about 300 to about 5000.

The polyolefin is preferably derived from an α-olefin, preferably one containing between about two to about eight carbon atoms. Ethylene and/or propylene are especially preferred. Suitable ethylenically unsaturated carboxylic acids are those having between about 3 to about 12 carbon atoms, preferably 4 to 5 carbon atoms. Dicarboxylic acids and anhydrides thereof are preferred. These include maleic acid, ethylmaleic acid, propylmaleic acid, isopropyl maleic acid, fumaric acid, methylenemalonic acid, glutaconic acid, itaconic acid, methylitaconic acid, mesacomic acid and citraconic acid and their mixtures, as well as the corresponding esters, anhydrides and mixtures of such acids, esters and anhydrides. Isopropyl maleic acid, esters and anhydrides therefore are especially preferred.

Suitable polymers are of the structural formula:

(VII)

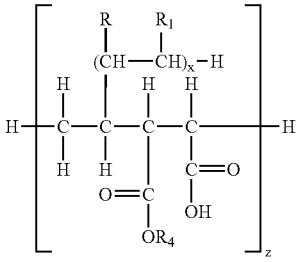

wherein R and $R_1$ individually represent hydrogen or a C1 to C10 alkyl group, preferably a C1 to C5 alkyl group, most preferably —H or —$CH_3$, and x generically represents a number from about 9 to 75; $R_4$ is a hydrogen or a $C_1$-$C_3$ alkyl group such as i-propyl; and z is between from about 5 to about 20. In a more preferred embodiment, R and $R_1$ are independently methyl or hydrogen; x is between from about 3 to about 15, and z is about 5 to about 14.

A particularly preferred polyolefin is CEREMER® 1608 polyolefin, available from Baker Petrolite, which is the reaction product of C>10 alpha alkenes (i.e., having more than 10 carbon atoms, suitably about 30), maleic anhydride, and mono-isopropyl maleate and exhibits a melting point of 76.7° C. (170° F.). The low molecular weight and maleic functionality of CERAMER Polymers display enhanced emulsification characteristics and improved compatibility with polymers containing oxygen functional groups, a high degree of functionality. compatibilization for polar/non-polar blends, dispersibility in water, and reactive site for derivatives.

CERAMER® 1608 is characterized by a molecular weight (gel permeation chromatography) of about 700, an acid number (BWM 3.01A) of 160, a saponification number (BWM 3.01A) of 212 and a penetration index at 25° C. (ASTM 1321) of 2.0. The molar ratio of α-olefin:isopropyl maleate in the copolymer is about 1:1. Some units of isopropyl maleate and/or maleic acid anhydride may further be grafted onto the copolymer backbone. Increasing the amount of acid (isopropyl maleate) favors formation of graft copolymers.

Regarding the branched olefins employed in the present invention, in one embodiment, the branched hydrocarbon has a number average molecular weight (as measured by vapor pressure osmometry) of at least about 300, preferably at least about 400, and more preferably at least about 500, and typically has a number average molecular weight of no more than about 10,000, preferably no more than about 5,000, and more preferably no more than about 3,000, although the molecular weight can be outside of these ranges. The branched hydrocarbon typically has a melting point (for crystalline materials) or a softening point (for amorphous or semicrystalline materials) of at least about 30° C., preferably at least about 35° C., and more preferably at least about 50° C., and typically has a melting point or softening point of no more than about 120° C., preferably no more than about 110° C., and more preferably no more than about 100° C., although the melting point can be outside of these ranges. The degree of branching (or average number of branches per molecule) in the branched hydrocarbon typically is at least about 4, and preferably at least about 5, and typically is no more than about 15, and preferably no more than about 10, although the degree of branching can be outside of these ranges. The hydrocarbon can be saturated or unsaturated, and can include cyclic moieties. In addition, oxidized hydrocarbons, such as polyethylene-based oxidized materials and microcrystalline-based oxidized materials can be used, as can unsaturated and branched hydrocarbon-like molecules using as a core cyclic compounds or dendrimer or arborols. Also suitable are homopolymers and copolymers prepared from monomers of the formula RCH═$CH_2$ wherein R is an alkyl group, typically with from about 1 to about 18 carbon atoms, and preferably with from about 3 to about 12 carbon atoms, although the number of carbon atoms can be outside of these ranges. The polymerized alpha-olefin used in this invention is also known as an olefin derived hydrocarbon polymer or catalytically polymerized alpha-olefin. The polymerized alpha-olefins are prepared from alpha-olefins having the formula:

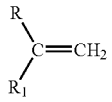

where R is $C_6$ to $C_{50}$ alkyl, preferably $C_{18}$-$C_{40}$ alkyl and $R^1$ is hydrogen or $C_6$ to $C_{50}$ alkyl, preferably hydrogen. The polymerization process is described in U.S. Pat. No. 4,060,569 which is incorporated herein by reference. The alpha-olefin is polymerized in the presence of a free radical catalyst. The nature of the free radical catalyst is not critical. Typical free radical catalysts include peroxides and hydroperoxides. The molar ratio of free radical catalyst to alpha-olefin is from about 0.005 to 0.35. A convenient measure of the effective presence of a free radical catalyst is its half-life which is employed as a measure of reaction time based on the number of half-lives. In general, reaction times of from about 1 to 20 half-lives are suitable. The polymerization is carried out at low pressures. The only pressure needed is that necessary to prevent vaporization of the free radical or alpha-olefin. Such pressures are typically less than about 500 psig. The polymerization temperature is typically set such that the free radical catalyst would have a half-life between 0.5 and 3 hours. This in turn is a function of the temperature at which the free radical catalyst decomposes. For peroxides and hydroperoxides, such temperatures are generally in a range from about 40° C. to 250° C. The reaction temperature employed will depend on the decomposition temperature of the particular peroxide or hydroperoxide used as catalyst.

The polymerized alpha-olefins are characterized in that they have higher viscosities and greater hardness but lower melting and congealing points than the alpha-olefins from which they are derived. This is in contrast to typical hydrocarbon polymers which have higher viscosities and greater hardness but also higher melting and congealing points than the hydrocarbon monomers from which they are derived. Because of their relatively low molecular weights, the polymerized alpha-olefins are also known as polymeric waxes or polymerized alpha-olefin waxes.

The polymerized alpha-olefins are commercially available. Suitable polymerized alpha-olefins are available from the Bareco Division of Petrolite Corporation under the registered trademark VYBAR, which is available in solid (e.g. VYBAR 103, VYBAR 260) or liquid (e.g. VYBAR 825) form. (VYBAR is a trademark of Petrolite Corporation.) The use of the polymerized alpha-olefin in solid rather than liquid form is preferred.

VYBAR® is a polymerized α-olefin prepared by polymerizing α-olefins under free radical conditions at low pressures. The polymers are unique in that although α-olefin polymers generally have higher molecular weight, greater viscosity and greater hardness than the starting monomer, VYBAR polymers generally have lower melting points and congealing points than the starting monomer. The monomers employed are primarily alpha-olefins of the formula $RCH{=}CH_2$ where R is an alkyl group having about 4 to 50 carbon atoms or is a mixture of alpha-olefins, vinylidene compounds, internal olefins and saturated hydrocarbons. Because alpha-olefins are primarily employed, this term is often used to indicate both alpha-olefins and mixtures of various combinations of alpha-olefins, vinylidenes, internal olefins and saturates.

Examples of suitable branched hydrocarbons include VYBAR® 253 available from Baker Petrolite Corp., an alpha-olefin with a number average molecular weight of about 520, a softening point of about 67° C. (measured by ASTM method D36) and a degree of branching of from about 5 to about 10. This material is a polymer based on an ethylene structure having pendant hydrocarbon side chains, also referred to as a poly-α-olefin or a poly-1-alkene. Also suitable are VYBAR® 103, with a number average molecular weight of 2,800, VYBAR® 260, with a number average molecular weight of 2,600, and the VYBAR® X-series polymers, such as X-6044, X-6059, X-6028, and the like. Also suitable are oxidized hydrocarbons such as those available from Petrolite as polyethylene-based oxidized materials and microcrystalline-based oxidized materials, such as the CARDIS® and PETRONAUBA® materials.

A particularly preferred branched polyolefin is X-6031® (a.k.a. Vybar® 103), CAS #68527-08-2, described as alkenes, macromonomers with C>10 (greater than 10 carbon atoms) alpha-polymerized with a softening point of 74° C. (165.2° F.).

Regarding the third wax employed in the present invention, in general any suitable wax which will form a hydrophobic coating can be employed in this invention. Thus, animal, vegetable, mineral and synthetic waxes may be employed.

Generally speaking, a wax is a substance which is a solid at ambient temperature and which has a low viscosity at just above its melting point. Typically, a wax is a substance having the following properties: (1) crystalline to microcrystalline structure, (2) capacity to acquire gloss when rubbed (as distinct from greases), (3) capacity to produce pastes or gels with suitable solvents or when mixed with other waxes, (4) low viscosity at just above the melting point. See *Grant & Hackh's Chemical Dictionary* (5$^{th}$ Edition), page 628, hereby incorporated by reference. Waxes differ from fats in that fats are the esters of the trihydric, lower alcohols.

The following are illustrative types of waxes which may be employed:

| Source | Examples | Compositions |
|---|---|---|
| Mineral Waxes | Paraffin | 26-30 Carbon atom molecules of aliphatic hydrocarbons. |
| | Microcrystalline | 41-50 Carbon atom molecules of branched-chain hydrocarbons. |

-continued

| Source | Examples | Compositions |
|---|---|---|
| | Oxidized microcrystalline | Hydrocarbons, esters, fatty acids. |
| | Montan | Wax acids, alcohols, esters, ketones. |
| | Hoechst | Acids, esters (obtained by oxidizing montan wax); |
| | Ozokerite | High mol. wt. aliphatic and alkenyl hydrocarbons. |
| Vegetable Waxes | Carnauba | Complex alcohols, hydrocarbons, resins. |
| | Esparto | Mainly hydrocarbons. |
| | Flax | Fatty acid esters, hydrocarbons. |
| | Sugarcane wax | Hydrocarbons, aldehydes, esters. alcohols. |
| | Candelilla | Hydrocarbons, acids, esters, alcohols, resins. |
| Animal Waxes | Beeswax | Hydrocarbons, acids, esters, alcohols, lactones. |
| Synthetic Waxes | Fischer-Tropsch, Polyolefins | Saturated and unsaturated hydrocarbons, oxygen-containing hydrocarbons. |

One preferred wax is a saturated or unsaturated hydrocarbon polymer that is not highly branched. Preferably the third wax is substantially linear. In one preferred embodiment, the third wax is the fully saturated homopolymers of polyethylene, or copolymers of various alkene monomers, forming polymers with a molecular weight at or below 3,000, a melting point below 130° C., and low melt viscosities. Applicable waxes could include "POLYWAX" available from Petrolite Corp. (St. Louis, Mo.)

POLYWAX® is a linear polyethylene wax. A particularly preferred wax is X-2071® (a.k.a. Polywax® 400), CAS # 9002-88-4, described as polyethylene homopolymer with weight average molecular weight of about 400 and a melting point of 79.5° C. (175.1° F.).

The wax mixture defined above can be employed in the invention herein at any concentration useful for the intended purpose. In general, good results have been obtained at a concentration of about 0.02 to about 0.12 g/m$^2$, preferably about 0.03 to about 0.09 g/m$^2$, with or without a binder.

Any binder may also be used in the slipping layer of the invention provided it will be useful for the intended effect. In a preferred embodiment, polymeric thermoplastic binders are employed. Examples of such materials include, for example, Poly(styrene-coacrylonitrile) (70/30 wt. ratio); poly(vinyl alcohol-co-butyral) (available commercially as Butvar 76.RTM. by Monsanto Corp.); poly(vinyl alcohol-co-acetal); poly(vinyl alcohol-co-benzal); polystyrene; poly(vinyl acetate); cellulose acetate butyrate; cellulose acetate propionate; cellulose acetate; ethyl cellulose; cellulose triacetate; poly(methylmethacrylate); copolymers of methyl methacrylate; etc. In another preferred embodiment of the invention, the thermoplastic binder is cellulose acetate propionate or polyvinyl acetal.

The amount of the optional binder employed in the slipping layer of the invention is not critical. In general, the binder may be employed in an amount of from about 0.1 to about 2 g/m$^2$.

Any dye can be used in the dye layer of the dye-donor element of the invention provided it is transferable to the dye-receiving layer by the action of heat. Especially good results have been obtained with sublimable dyes.

A preferred embodiment utilizes a magenta dye, alone or in combination, comprising at least a first magenta dye of the following structure I:

(I)

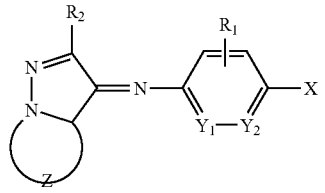

wherein X represents a $NR_3R_4$ group or a hydroxyl group, wherein $R_3$ and $R_4$ may be same or different and are independently selected from an alkyl, alkenyl, aryl, aralkyl, or cycloalkyl group; $Y_1$ and $Y_2$ each independently are selected from a carbon atom or a nitrogen atom, provided that one of $Y_1$ and $Y_2$ is a nitrogen atom; Z represents an atomic group necessary to form a 5- or 6-membered nitrogen-containing heterocyclic ring which may be condensed with another ring; and $R_1$ and $R_2$ are each independently selected from a hydrogen atom, halogen atom, alkyl, alkenyl, alkoxy, alkylamino, acetamido, sulfonamide, aryl, aralkyl, or cycloalkyl group;

and optionally, a second magenta dye of the structure II:

(II)

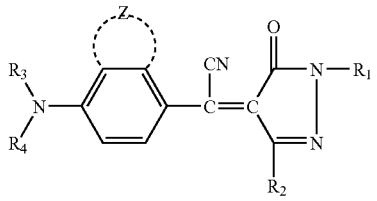

wherein:

$R_1$ represents an alkyl group having from 1 to 10 carbon atoms, a cycloalkyl group having from 5 to 7 carbon atoms, or an aryl group having from 6 to 10 carbon atoms;

$R_2$ represents an alkoxy group having from 1 to 10 carbon atoms, an aryloxy group having from 6 to 10 carbon atoms, naphthoxy, $NHR_5$, $NR_5$, or $R_6$;

$R_3$ and $R_4$ are each independently $R_1$, or either or both of $R_3$ and $R_4$ can be joined to the carbon atom of the aromatic ring at a position ortho to the position of attachment of the anilino nitrogen to form a 5- or 6-membered ring, or $R_3$ and $R_4$ can be joined together to form a 5- or 6-membered heterocyclic ring with the nitrogen to which they are attached;

$R_5$ and $R_6$ each independently represents an alkyl group having from 1 to 10 carbon atoms, a cycloalkyl group having from 5 to 7 carbon atoms, or an aryl group having from 6 to 10 carbon atoms, or $R_5$ and $R_6$ may be joined together to form, along with the nitrogen to which they are attached, a 5- or 6-membered heterocyclic ring; and Z represents hydrogen or the atoms necessary to complete a 5- or 6-membered ring. Additional magenta dyes can be added to the composition.

One or more dyes of structure I can be included in a total amount of from 10 to 90% by weight of the composition, for example, from 15 to 90% by weight, or from 25 to 75% by weight of the composition. Structure I is as follows:

(I)

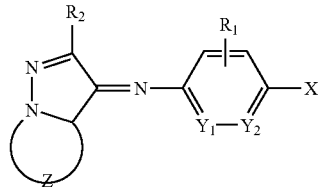

wherein X represents a $NR_3R_4$ group or a hydroxyl group, wherein $R_3$ and $R_4$ may be same or different and are independently selected from an alkyl, alkenyl, aryl, aralkyl, or cycloalkyl group; $Y_1$ and $Y_2$ each independently are selected from a carbon atom or a nitrogen atom, provided that one of $Y_1$ and $Y_2$ is a nitrogen atom; Z represents an atomic group necessary to form a 5- or 6-membered nitrogen-containing heterocyclic ring which may be condensed with another ring; and $R_1$ and $R_2$ are each independently selected from a hydrogen atom, halogen atom, alkyl, alkenyl, alkoxy, alkylamino, acetamido, sulfonamide, aryl, aralkyl, or cycloalkyl group. According to certain embodiments, Structure I, $Y_1$ can be a carbon atom, $Y_2$ can be a nitrogen atom, X can be an $NR_3R_4$ group wherein $R_3$ and $R_4$ may be same or different alkyl, Z can be a 5-membered nitrogen-containing heterocyclic ring, $R_1$ can be a hydrogen or alkyl group, and $R_2$ can be an alkyl group.

The dye of structure I can be as follows:

(Ia)

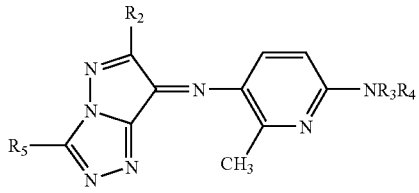

wherein $R_3$ and $R_4$ can be the same or different and are independently selected from an alkyl and an alkenyl; $R_2$ can be a $C_{1-6}$ alkyl; and $R_5$ can be a $C_{1-10}$ alkyl group, a $C_{5-7}$ cycloalkyl group, or a $C_{6-10}$ aryl group. According to certain embodiments, the dye of structure I can be as follows:

(Ib)

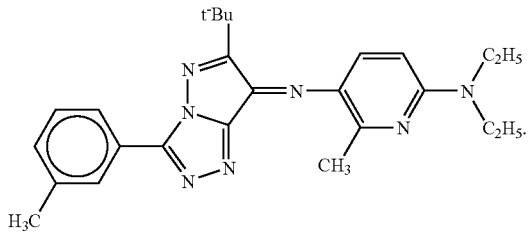

Methods of forming the dye of structures I, Ia and Ib are known in the art and can be found, for example, in U.S. Pats. Nos. 5,476,943 and 5,532,202.

A magenta dye of structure II can be included in the composition. One or more dyes of structure II can be included in a total amount of from 10 to 90% by weight of the composition, for example, from 10 to 85% by weight, or from 25 to 75% by weight of the composition. The magenta dye of structure II has the following formula:

(II)

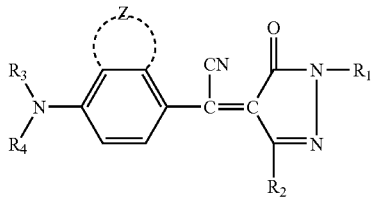

wherein:

$R_1$ represents an alkyl group having from 1 to 10 carbon atoms, a cycloalkyl group having from 5 to 7 carbon atoms, or an aryl group having from 6 to 10 carbon atoms;

$R_2$ represents an alkoxy group having from 1 to 10 carbon atoms, an aryloxy group having from 6 to 10 carbon atoms, naphthoxy, $NHR_5$, $NR_5$, or $R_6$;

$R_3$ and $R_4$ are each independently $R_1$, or either or both of $R_3$ and $R_4$ can be joined to the carbon atom of the aromatic ring at a position ortho to the position of attachment of the anilino nitrogen to form a 5- or 6-membered ring, or $R_3$ and $R_4$ can be joined together to form a 5- or 6-membered heterocyclic ring with the nitrogen to which they are attached;

$R_5$ and $R_6$ each independently represents an alkyl group having from 1 to 10 carbon atoms, a cycloalkyl group having from 5 to 7 carbon atoms, or an aryl group having from 6 to 10 carbon atoms, or $R_5$ and $R_6$ may be joined together to form, along with the nitrogen to which they are attached, a 5- or 6-membered heterocyclic ring; and Z represents hydrogen or the atoms necessary to complete a 5- or 6-membered ring.

According to certain embodiments, in structure II, $R_1$ can be phenyl or methyl; $R_3$ and $R_4$ can each independently be selected from methyl or ethyl; and $R_2$ can be $NR_5R_6$, wherein each of $R_5$ and $R_6$ is independently selected from methyl or ethyl. According to certain embodiments, structure II can be as follows:

(IIa)

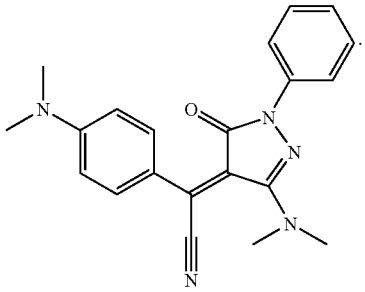

The magenta dye combination can be a combination of structure Ib and structure IIa.

Additional magenta dyes as known in the art can be added to the magenta dye combination including magenta dyes of structures I and II. For example, known magenta dyes include MS Red G (Disperse Red 60, manufactured by Mitsui Toatsu Chemicals, Inc.), Macrolex Violet R (Disperse Violet 26, manufactured by Bayer), and dyes of Structures III and IV shown below. Exemplary additional dyes can include dyes of structure IIIa, IVa, and IVb below, or combinations thereof.

Dyes of structure III are as follows:

(III)

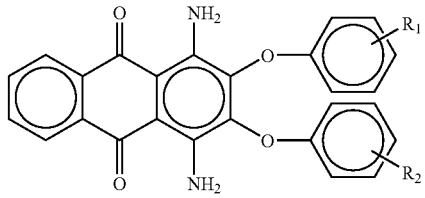

wherein $R_1$ and $R_2$ are each independently selected from hydrogen, hydroxyl, halogen, $C_{1-4}$ alkyl, or $C_{1-4}$ alkoxy. According to certain embodiments, $R_1$ and $R_2$ can be hydrogen, producing the dye of structure IIIa:

(IIIa)

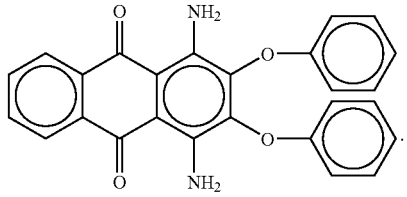

Dyes of structure IV are as follows:

(IV)

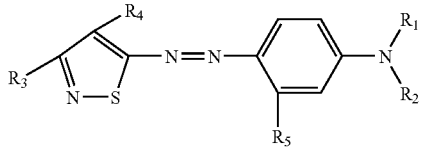

wherein $R_1$ and $R_2$ are each independently hydrogen, $C_{1-6}$ alkyl or allyl, $C_{5-7}$ cycloalkyl, $C_{5-10}$ aryl, or $R_1$ and $R_2$ can be taken together to form a 5- or 6-membered heterocyclic ring which can include the nitrogen to which $R_1$ or $R_2$ is attached, and either carbon atom ortho to the carbon attached to the nitrogen atom;

$R_3$ is a hydrogen, $C_{1-6}$ alkyl, $C_{5-10}$ aryl, alkylthio, or halogen;

$R_4$ is cyano, thiocyanato, alkylthio, or alkoxycarbonyl; and $R_5$ is a $C_{1-6}$ alkyl, a $C_{5-10}$ aryl, or NHA, where A is an acyl or sulfonyl radical. Exemplary dyes of structure IV include:

(IVa)

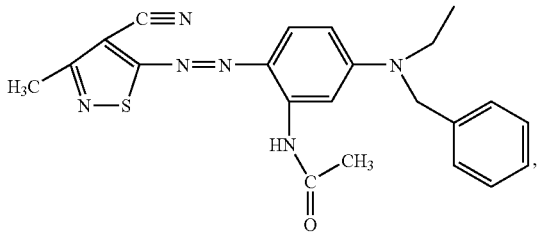

, and

-continued (IVb)

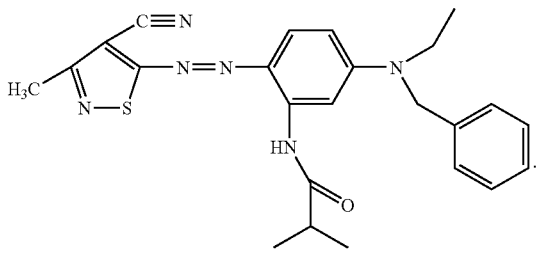

The magenta dye combinations as described herein can be used in a dye-donor layer of a thermal dye-donor element to form images by thermal printing. The dye-donor layer can include the magenta dye combination alone, or multiple colored areas (patches) containing dyes suitable for thermal printing. As used herein, a "dye" can be one or more dye, pigment, colorant, or a combination thereof, and can optionally be in a binder or carrier as known to practitioners in the art. For example, the dye layer can include the magenta dye combination and further comprise a yellow dye-donor patch comprising at least one bis-pyrazolone-methine dye and at least one other pyrazolone-methine dye, and a cyan dye-donor patch comprising at least one indoaniline cyan dye Any dye transferable by heat can be used in the dye-donor layer of the dye-donor element. The dye can be selected by taking into consideration hue, lightfastness, and solubility of the dye in the dye donor layer binder and the dye image receiving layer binder. Suitable magenta dye combinations are discussed above.

Examples of sublimable dyes include anthraquinone dyes, e.g., Sumikalon Violet RS® (Sumitomo Chemical Co., Ltd.), Dianix Fast Violet 3R FS® (Mitsubishi Chemical Industries, Ltd.), and Kayalon Polyol Brilliant Blue N BGM® and KST Black 146® (Nippon Kayaku Co., Ltd.); azo dyes such as Kayalon Polyol Brilliant Blue BM®, Kayalon Polyol Dark Blue 2BM®, and KST Black KR® (Nippon Kayaku Co., Ltd.), Sumickaron Diazo Black 5G® (Sumitomo Chemical Co., Ltd.), and Miktazol Black 5 GH® (Mitsui Toatsu Chemicals, Inc.); direct dyes such as Direct Dark Green B® (Mitsubishi Chemical Industries, Ltd.) and Direct Brown M® and Direct Fast Black D® (Nippon Kayaku Co. Ltd.); acid dyes such as Kayanol Milling Cyanine 5R® (Nippon Kayaku Co. Ltd.); basic dyes such as Sumicacryl Blue 6G® (Sumitomo Chemical Co., Ltd.), and Aizen Malachite Green® (Hodogaya Chemical Co., Ltd.); or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

Examples of further suitable dyes, including further magenta, yellow, and cyan dyes, can include, but are not limited to, diarylmethane dyes; triarylmethane dyes; thiazole dyes, such as 5-arylisothiazole azo dyes; methine dyes such as merocyanine dyes, for example, aminopyrazolone merocyanine dyes; azomethine dyes such as indoaniline, acetophenoneazomethine, pyrazoloazomethine, imidazoleazomethine, imidazoazomethine, pyridoneazomethine, and tricyanopropene azomethine dyes; xanthene dyes; oxazine dyes; cyanomethylene dyes such as dicyanostyrene and tricyanostyrene dyes; thiazine dyes; azine dyes; acridine dyes; azo dyes such as benzeneazo, pyridoneazo, thiopheneazo, isothiazoleazo, pyrroleazo, pyrraleazo, imidazoleazo, thiadiazoleazo, triazoleazo, and disazo dyes; arylidene dyes such as alpha-cyano arylidene pyrazolone and aminopyrazolone arylidene dyes; spiropyran dyes; indolinospiropyran dyes; fluoran dyes; rhodaminelactam dyes; naphthoquinone dyes, such as 2-carbamoyl-4-[N-(p-substituted aminoaryl)imino]-1,4-naphthaquinone; anthraquinone dyes; and quinophthalone dyes. Specific examples of dyes usable herein can include:

C.I. (color index) Disperse Yellow 51, 3, 54, 79, 60, 23, 7, and 141;

C.I. Disperse Blue 24, 56, 14, 301, 334, 165, 19, 72, 87, 287, 154, 26, and 354;

C.I. Disperse Red 135, 146, 59, 1, 73, 60, and 167;

C.I. Disperse Orange 149;

C.I. Disperse Violet 4, 13, 36, 56, and 31;

C.I. Disperse Yellow 56, 14, 16, 29, and 231;

C.I. Solvent Blue 70, 35, 36, 50, 49, 111, 105, 97, and 11;

C.I. Solvent Red 135, 81, 18, 25, 19, 23, 24, 143, 146, and 182;

C.I. Solvent Violet 13;

C.I. Solvent Black 3; and

C.I. Solvent Green 3.

Further examples of sublimable or diffusible dyes that can be used include anthraquinone dyes, such as Sumikalon Violet RS® (product of Sumitomo Chemical Co., Ltd.), Dianix Fast Violet 3R-FS® (product of Mitsubishi Chemical Corporation.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5 GH® (product of Mitsui Toatsu Chemicals, Inc.); direct dyes such as Direct Dark Green B® (product of Mitsubishi Chemical Corporation) and Direct Brown M® and Direct Fast Black D® (products of Nippon Kayaku Co. Ltd.); acid dyes such as Kayanol Milling Cyanine 5R® (product of Nippon Kayaku Co. Ltd.); and basic dyes such as Sumicacryl Blue 6G® (product of Sumitomo Chemical Co., Ltd.), and Aizen Malachite Green® (product of Hodogaya Chemical Co., Ltd.).

Another preferred embodiment utilizes a cyan dye, alone or in combination, comprising at least a first cyan dye of the following structure XX:

(XX)

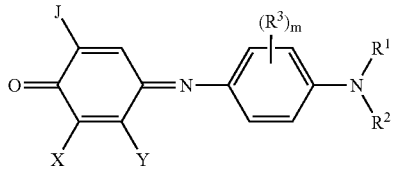

wherein: $R^1$ and $R^2$ each independently represents hydrogen; an alkyl group having from 1 to about 6 carbon atoms; a cycloalkyl group having from about 5 to about 7 carbon atoms; allyl; or such alkyl, cycloalkyl or allyl groups substituted with one or more groups such as alkyl, aryl, alkoxy, aryloxy, amino, halogen, nitro, cyano, thiocyano, hydroxy, acyloxy, acyl, alkoxycarbonyl, aminocarbonyl, alkoxycarbonyloxy, carbamoyloxy, acylamido, ureido, imido, alkylsulfonyl, arylsulfonyl, alkylsulfonamido, arylsulfonamido, alkylthio, arylthio, trifluoromethyl, etc., e.g., methyl, ethyl, propyl, isopropyl, butyl, pentyl, hexyl, methoxyethyl, benzyl, 2-methanesulfonamidoethyl, 2-hydroxyethyl, 2-cyanoethyl, methoxycarbonylmethyl, cyclohexyl, cyclopentyl, phenyl, pyridyl, naphthyl, thienyl, pyrazolyl, p-tolyl, p-chlorophenyl, m-(N-methyl-sulfamoyl)phenylmethyl, methylthio, butylthio, benzylthio, methanesulfonyl, pentanesulfonyl, methoxy, ethoxy, 2-methane-sulfonamidoethyl, 2-hydroxyethyl, 2-cyanoethyl, methoxy-carbonyl-methyl, imidazolyl, naphthyloxy, furyl, p-tolylsulfonyl, p-chlorophenylthio, m-(N-methyl sulfamoyl)phenoxy, ethoxycarbonyl, methoxyethoxycarbonyl, phenoxycarbonyl, acetyl, benzoyl, N,N-dimethylcarbamoyl, dimethylamino, morpholino, anilino, pyrrolidino etc.;

each $R^3$ independently represents hydrogen, substituted or unsubstituted alkyl, cycloalkyl or allyl as described above for $R^1$ and $R^2$; alkoxy, aryloxy, halogen, thiocyano, acylamido, ureido, alkylsulfonamido, arylsulfonamido, alkylthio, arylthio or trifluoromethyl;

or any two of $R^3$ may be combined together to form a 5- or 6-membered carbocyclic or heterocyclic ring;

or one or two of $R^3$ may be combined with either or both of $R^1$ and $R^2$ to complete a 5- to 7-membered ring;

m is an integer of from 0 to 4;

X represents hydrogen, halogen or may be combined together with Y to represent the atoms necessary to complete a 6-membered aromatic ring, thus forming a fused bicyclic quinoneimine, such as a naphthoquinoneimine;

J represents $NHCOR^4$, $NHCO_2R^4$, $NHCONHR^4$ or $NHSO_2R^4$; and with the proviso that when X is combined with Y, then J represents $CONHR^4$, $SO_2NHR^4$, CN, $SO_2R^4$ or SCN, in which case, however, $R^4$ cannot be hydrogen;

$R^4$ is the same as $R^1$ or represents an aryl group having from about 6 to about 10 carbon atoms; a hetaryl group having from about 5 to about 10 atoms; or such aryl or hetaryl groups substituted with one or more groups such as are listed above for $R^1$ and $R^2$; and Y is the same as $R^4$, or acylamino or may be combined together with X as described above.

Other suitable cyan dyes can include Kayaset Blue 714 (Solvent Blue 63, manufactured by Nippon Kayaku Co., Ltd.), Phorone Brilliant Blue S-R (Disperse Blue 354, manufactured by Sandoz K.K.), Solvent Blue 63, and cyan dyes of the structures

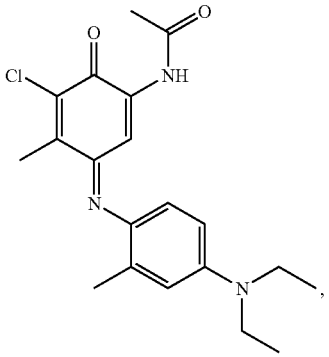

-continued

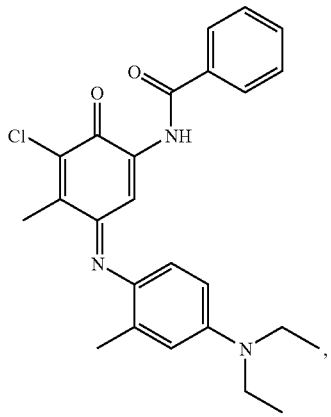

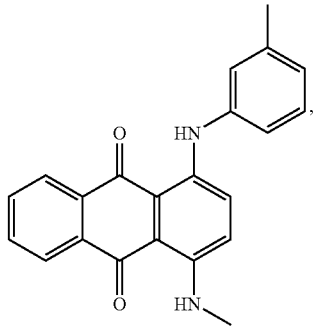

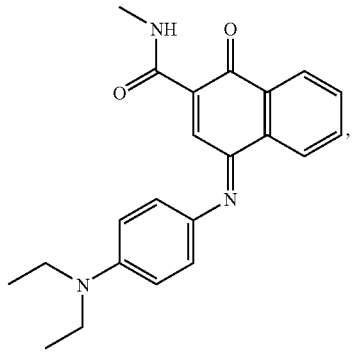

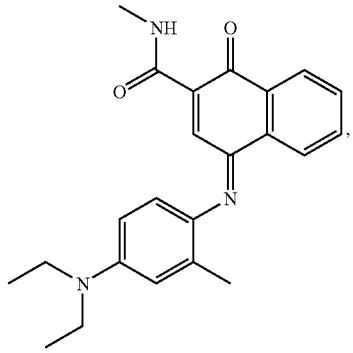

-continued

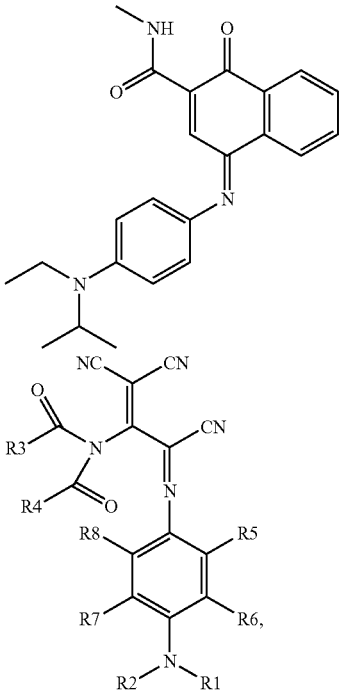

, and where R1 and R2 each independently represents an alkyl group, a cycloalkyl group, an aryl group, a heterocyclic group, or R1 and R2 together represent the necessary atoms to close a heterocyclic ring, or R1 and/or R2 together with R6 and/or R7 represent the necessary atoms to close a heterocyclic ring fused on the benzene ring; R3 and R4 each independently represents an alkyl group, or an alkoxy group; R5, R6, R7 and R8 each independently represents hydrogen, an alkyl group, a cycloalkyl group, an aryl group, an alkoxy group, an aryloxy group, a carbonamido group, a sulfamido group, hydroxy, halogen, $NHSO_2R_9$, $NHCOR_9$, $OSO_2R_9$, or $OCOR_9$, or R5 and R6 together and/or R7 and R8 together represent the necessary atoms to close one or more heterocyclic ring fused on the benzene ring, or R6 and/or R7 together with R1 and/or R2 represent the necessary atoms to close a heterocyclic ring fused on the benzene ring; and R9 represents an alkyl group, a cycloalkyl group, an aryl group and a heterocyclic group.

Another preferred embodiment utilizes a yellow dye, alone or in combination, comprising at least a first yellow dye of the following structure X:

(X)

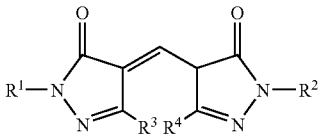

wherein $R^1$ and $R^2$ can be respectively independently selected and are a lower alkyl group which may be substituted, a lower alkenyl group which may be substituted or an aryl group which may be substituted; and $R^3$ and $R^4$ can be respectively independently selected and are a lower alkyl group which may be substituted, a dialkylamino group, a —$COOR^5$ group or a —$CONR^6R^7$ group, in which $R^5$ is a lower alkyl group which may be substituted, a lower alkenyl group which may be substituted or an aryl group which may be substituted and $R^6$ and $R^7$ can be respectively independently selected and are a hydrogen atom, a lower alkyl group which may be substituted, a lower alkenyl group which may be substituted or an aryl group which may be substituted.

A preferred yellow dye of structure X specifically has the following structure:

(Xa)

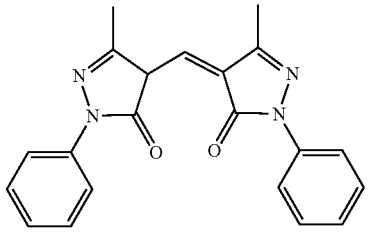

Another preferred embodiment utilizes a yellow dye, alone or in combination, comprising at least a first yellow dye of the following structure XI:

(XI)

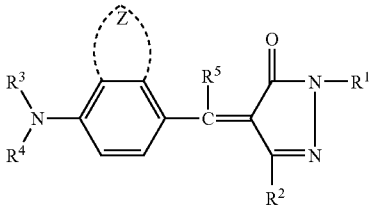

wherein $R^1$ represents a substituted or unsubstituted alkyl group having from 1 to about 10 carbon atoms; a cycloalkyl group having from about 5 to about 7 carbon atoms or an aryl group having from about 6 to about 10 carbon atoms;

$R^2$ represents a substituted or unsubstituted alkoxy group having from 1 to about 10 carbon atoms; a substituted or unsubstituted aryloxy group having from about 6 to about 10 carbon atoms; $NHR^6$; $NR^6R^7$ or the atoms necessary to complete a 6-membered ring fused to the benzene ring;

$R^3$ and $R^4$ each represents $R^1$; or $R^3$ and $R^4$ can be joined together to form, along with the nitrogen to which they are attached, a 5- or 6-membered hetercyclic ring;

$R^5$ represents hydrogen; halogen; carbamoyl; alkoxycarbonyl; acyl; a substituted or unsubstituted alkyl or alkoxy group having from 1 to about 10 carbon atoms; a cycloalkyl group having from about 5 to about 7 carbon atoms; an aryl group having from about 6 to about 10 carbon atoms; or a dialkylamino group;

$R^6$ and $R^7$ each independently represents a substituted or unsubstituted alkyl group having from 1 to about 10 carbon atoms; a cycloalkyl group having from about 5 to about 7 carbon atoms or an aryl group having from about 6 to about 10 carbon atoms; $R^6$ and $R^7$ may be joined together to form, along with the nitrogen to which they are attached, a 5- or 6-membered heterocyclic ring; and Z represents hydrogen or the atoms necessary to complete a 5- or 6-membered ring.

A preferred yellow dye of structure XI specifically has the following structure:

(XIa)

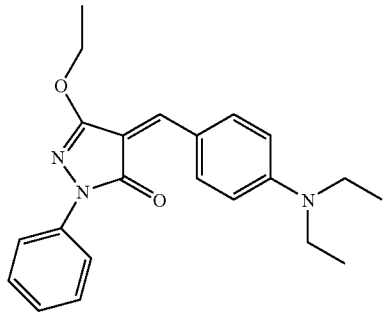

Another preferred embodiment utilizes a yellow dye, alone or in combination, comprising at least a first yellow dye of the following structure XII:

(XII)

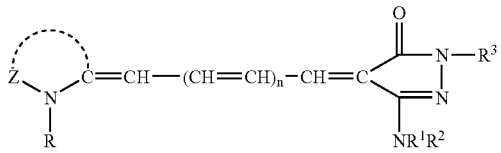

wherein:

R represents a substituted or unsubstituted alkyl group of from 1 to about 6 carbon atoms or a substituted or unsubstituted aryl group of from about 6 to about 10 carbon atoms;

$R^1$ and $R^2$ each independently represents hydrogen, with the proviso that only one of $R^1$ and $R^2$ may be hydrogen at the same time; a substituted or unsubstituted alkyl group of from 1 to about 6 carbon atoms or a substituted or unsubstituted aryl group of from about 6 to about 10 carbon atoms; or $R^1$ and $R^2$ may be combined together with the nitrogen to which they are attached to form a heterocyclic ring system;

$R^3$ is R;

n represents 0 or 1; and

Z represents the atoms necessary to complete a 5- or 6-membered substituted or unsubstituted heterocyclic ring.

A preferred yellow dye of structure XII specifically has the following structure:

(XIIa)

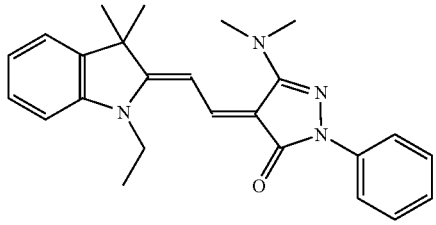

Another preferred embodiment utilizes a yellow dye, alone or in combination, comprising at least a first yellow dye of the following structure XIII:

(XIII)

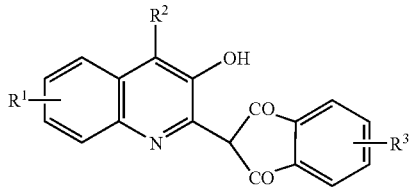

wherein $R_1$ is an alkyl group having 1 to 8 carbon atoms or cycloalkyl group;

$R_2$ is a hydrogen atom, halogen atom, alkoxy group which may be substituted, alkylthio group which may be substituted or arylthio group which may be substituted;

$R_3$ is a branched alkyl group having 3 to 5 carbon atoms, an O-substituted oxycarbonyl group, an N-substituted aminocarbonyl group in which the N-substituted group may form a ring, or a substituted or unsubstituted heterocyclic ring having two or more hetero atoms of one or more kinds selected from the group consisting of a nitrogen atom, oxygen atom and sulfur atom.

A preferred yellow dye of structure XIII specifically has the following structure:

(XIIIa)

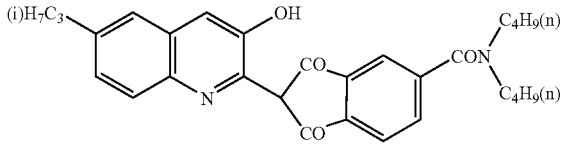

Other suitable yellow dyes can include Phorone Brilliant Yellow S-6 GL (Disperse Yellow 231, manufactured by Sandoz K.K.) and Macrolex Yellow 6G (Disperse Yellow 201, manufactured by Bayer), and yellow dyes of the structures:

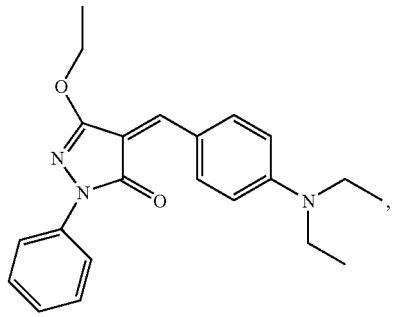

-continued

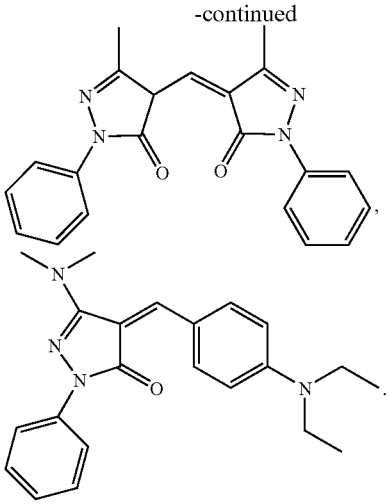

, and

Further examples of useful dyes can be found in U.S. Pat. Nos. 4,541,830; 4,698,651; 4,695,287; 4,701,439; 4,757,046; 4,743,582; 4,769,360; 4,753,922; 4,910,187; 5,026,677; 5,101,035; 5,142,089; 5,374,601; 5,476,943; 5,532,202; 5,804,531; 6,265,345, and U.S. Patent Application Publication No. US 2003/0181331, the disclosures of which are hereby incorporated by reference.

The dyes can be employed singly or in combination to obtain a monochrome dye-donor layer or a black dye-donor layer. The dyes can be used in an amount of from 0.05 g/m$^2$ to 1 g/m$^2$ of coverage. According to various embodiments, the dyes can be hydrophobic.

During thermal printing, at least a portion of one or more colored areas can be transferred from the dye-donor layer of the dye-donor element to a receiver element, forming a colored image on the receiver element. The dye-donor layer can include a laminate area (patch) having no dye. The laminate area can follow one or more colored areas on the dye-door element. During thermal printing, the entire laminate area can be transferred to the receiver element. The dye-donor layer can include one or more colored areas and one or more laminate areas. For example, the dye-donor layer can include three color patches, for example, yellow, magenta, and cyan, and a clear laminate patch, for forming a three color image with a protective laminate layer on the receiver element.

Each dye-donor layer patch can range from 20 wt. % to 90 wt. % dye, relative to the total dry weight of all components in the layer. A high amount of dye is desirable for increased efficiency, but higher amounts of dye can lead to increased occurrences of donor/receiver sticking. Depending on the efficiency of the dye-donor layer, a lower amount of dye can be used to achieve the same efficiency as a different dye-donor layer. The dye percent is ideally chosen in view of the specific donor and receiver combination. Varying the amount of dye in the donor can aid in matching the efficiency between different dye patches, for example, a cyan, magenta, and yellow patch. For example, yellow and/or magenta patch dye amounts can be between 20 wt. % and 75 wt. % dye relative to the total dry weight of all components in the layer, for example, between 30 wt. % and 50 wt. %. A cyan patch dye amount can be between 40 wt. % and 90 wt. % dye relative to the total dry weight of all components in the layer, for example, between 55 wt. % and 75 wt. %.

To form each color patch of a dye-donor layer, one or more dyes can be dispersed in a polymeric binder. The binder can be used in an amount of from 0.05 g/m$^2$ to 5 g/m$^2$. The polymeric binder can be, for example, a polycarbonate; a poly(styrene-co-acrylonitrile); a poly(sulfone); a poly(phenylene oxide); a cellulose derivative such as but not limited to cellulose acetate hydrogen phthalate, cellulose acetate, cellulose acetate propionate, cellulose acetate butyrate, or cellulose triacetate; or a combination thereof. Preferably, the polymeric binder is a cellulose ether or ester, for example, ethyl cellulose.

The dye-donor layer can have a dye to binder ratio for each color dye patch. For example, a yellow dye to binder ratio can be from 0.3 to 1.2, or from 0.5 to 1.0. A magenta dye to binder ratio can be from 0.5 to 1.5, or from 0.8 to 1.2. A cyan dye to binder ratio can be from 1.0 to 2.5, or from 1.5 to 2.0.

According to various embodiments, a subbing layer, for example, an adhesive or tie layer, a dye-barrier layer, or a combination thereof, can be coated between the support and the dye-donor layer. The subbing layer can be one or more layers. The adhesive or tie layer can adhere the dye-donor layer to the support. Suitable adhesives are known to practitioners in the art, for example, Tyzor TBT® from E.I. DuPont de Nemours and Company. The dye-barrier layer can include a hydrophilic polymer. The dye-barrier layer can provide improved dye transfer densities.

A dye-barrier layer may be employed in the dye-donor elements of the invention to improve the density of the transferred dye. Such dye-barrier layer materials include hydrophilic materials such as those described and claimed in U.S. Pat. No. 4,716,144 by Vanier, Lum and Bowman.

The dye layer of the dye-donor element may be coated on the support or printed thereon by a printing technique such as a gravure process.

The dye-donor layer of the dye-donor element can be formed or coated on a support. The dye-donor layer composition can be dissolved in a solvent for coating purposes. The dye-donor layer can be formed or coated on the support by techniques such as, but not limited to, a gravure process, spin-coating, solvent-coating, extrusion coating, or other methods known to practitioners in the art. Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide amides and polyetherimides. The support generally has a thickness of from about 2 to about 30 micrometers. It may also be coated with a subbing layer, if desired, such as those materials described in U.S. Pat. No. 4,695,288 or U.S. Pat. No. 4,737,486.

The dye-receiving element that is used with the dye-donor element of the invention usually comprises a support having thereon a dye image receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as DuPont Tyvek®.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

The support for the image receiving layer may be transparent or reflective, and may comprise a polymeric, a synthetic paper, or a cellulosic paper support, or laminates thereof. Examples of transparent supports include films of poly(ether sulfones), polyimides, cellulose esters such as cellulose acetate, poly(vinyl alcohol-co-acetals), and poly(ethylene terephthalate). The support may be employed at any desired thickness, usually from about 10 μm to 1000 μm. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965241, the disclosures of which are incorporated by reference. The receiver element may also include a backing layer such as those disclosed in U.S. Pat. Nos. 5,011,814 and 5,096,875, the disclosures of which are incorporated by reference. Supports for the dye receiving layer are, for example, disclosed in commonly assigned U.S. Pat. No. 5,244,861, EP0671281, and U.S. Pat. No. 5,928,990, which are hereby incorporated by reference in their entirety.

The composition, for use in an image-receiving layer, may also contain a release agent, such as a silicone or fluorine based compound, as is conventional in the art. Resistance to sticking during thermal printing may be enhanced by the addition of such release agents to the dye-receiving layer or to an overcoat layer. Various releasing agents are disclosed, for example, in U.S. Pat. No. 4,820,687 and U.S. Pat. No. 4,695,286, the disclosures of which are hereby incorporated by reference in their entirety.

The dye-donor element can include a stick preventative agent to reduce or eliminate sticking between the dye-donor element and the receiver element during printing. The stick preventative agent can be present in any layer of the dye-donor element, so long as the stick preventative agent is capable of diffusing through the layers of the dye-donor element to the dye-donor layer, or transferring from the slip layer to the dye-donor layer. For example, the stick preventative agent can be present in one or more patches of the dye-donor layer, in the support, in an adhesive layer, in a dye-barrier layer, in a slip layer, or in a combination thereof. According to various embodiments, the stick preventative agent can be in the slip layer, the dye-donor layer, or both. According to various embodiments, the stick preventative agent is in the dye-donor layer. The stick preventative agent can be in one or more colored patches of the dye-donor layer, or a combination thereof. If more than one dye patch is present in the dye-donor layer, the stick preventative agent can be present in the last patch of the dye-donor layer to be printed, typically the cyan layer. However, the dye patches can be in any order. For example, if repeating patches of cyan, magenta, and yellow are used in the dye-donor element, in that respective order, the yellow patches, as the last patches printed in each series, can include the stick preventative agent. The stick preventative agent can be a silicone- or siloxane-containing polymer.

Suitable polymers can include graft copolymers, block polymers, copolymers, and polymer blends or mixtures. Suitable stick preventative agents are described, for example, in U.S. Patent Application Publications US2005/0059550A1 and US2005/0059552A1.

Optionally, release agents as known to practitioners in the art can also be added to the dye-donor element, for example, to the dye-donor layer, the slip layer, or both. Suitable release agents can include, for example, those described in U.S. Pat. Nos. 4,740,496 and 5,763,358.

According to various embodiments, the dye-donor layer may contain no plasticizer. However, if plasticizer is used, inclusion of the plasticizer in the dye-donor layer can increase dye-donor efficiency. The dye-donor element can include plasticizers known in the art, such as those described in U.S. Pat. Nos. 5,830,824 and 5,750,465, and references disclosed therein. Suitable plasticizers can be defined as compounds having a glass transition temperature (Tg) less than 25° C., a melting point (Tm) less than 25° C., or both. Plasticizers useful for this invention can include low molecular weight plasticizers and higher molecular weight plasticizers such as oligomeric or polymeric plasticizers. Examples of suitable plasticizers can include aliphatic polyesters, epoxidized oils, chlorinated hydrocarbons, poly(ethylene glycols), poly(propylene glycols), and poly(vinyl ethyl ether) (PVEE). The molecular weight of the plasticizer can be greater than or equal to 450 to minimize transfer of the plasticizer to the dye-receiving layer during printing. The plasticizer can be present in an amount of from 1 to 50%, for example, from 5% to 35%, by weight of the binder.

Aliphatic polyesters suitable as plasticizers can be derived from succinic acid, glutaric acid, adipic acid, pimelic acid, suberic acid, azelaic acid, and sebacic acid. The aliphatic polyesters can have one or more functional end groups, for example a carboxyl, hydroxyl, or alkoxyl group, where each alkoxyl group can be from 1 to 18 carbon atoms. Examples of suitable aliphatic polyesters can include Drapex plasticizers (Crompton/Witco Corporation, Middlebury, Conn., USA), such as Drapex 429, and Admex plasticizers (Velsicol Chemical Corporation, Rosemont, Ill., USA) such as Admex 429, and Paraplex G25, Plasthall HA7A, Plasthall P650, Plasthall P-7092, all from CP Hall Company, Chicago, Ill., USA.

Epoxidized oils suitable as plasticizers can include partially or completely epoxidized natural oils, and partially or completely epoxidized derivatized natural oils such as epoxidized soybean oil sold as Paraplex G-60, Paraplex G-62, and Plasthall ESO; epoxidized linseed oil sold as Plasthall ELO; or epoxidized octyl tallate sold as Plasthall S-73, all from C. P. Hall Company.

Chlorinated hydrocarbons suitable for use as plasticizers can include long-chain hydrocarbons or paraffins consisting of methylene, methyl, methane or alkene groups, all of which can have a chlorine substitution. The length of the long-chain hydrocarbon can be between 8 and 30 carbon atoms, for example, between 12 and 24 carbon atoms. The chains can be branched. The amount of chlorine in the paraffin can be between 25 and 75 wt %, for example, between 40 and 70 wt %. Mixtures of chlorinated paraffins can also be used.

According to certain embodiments, the chlorinated paraffins can have the formula $C_xH_yC_z$ wherein x is between 11 and 24, y is between 14 and 43, and z is between 3 and 10. Examples of suitable chlorinated hydrocarbons can include Chlorowax liquids sold by Occidental Chemical Corp., Dallas, Tex., USA, and Paroil paraffins sold by Dover Chemical Corp., Dover, Ohio, USA, such as Chlorowax 40 and Paroil 170HV.

Poly(ethylene glycols) and poly(propylene glycols) suitable for use as plasticizers can have unsubstituted end groups (OH), or they can be substituted with one or more functional groups such as an alkoxyl group or fatty acid, where each alkoxyl group or fatty acid can be from 1 to 18 carbon atoms. Examples of suitable poly(ethylene glycols) and poly(propylene glycols) can include TegMer 809 poly(ethylene glycol) from C. P. Hall Co., and PPG #483 poly(propylene glycol) from Scientific Polymer Products, Ontario, N.Y., USA.

The dye-donor layer can include beads. The beads can have a particle size of from 0.5 to 20 microns, preferably from 2.0 to 15 microns. The beads can act as spacer beads under the compression force of a wound up dye-donor roll, improving raw stock keeping of the dye-donor roll by reducing the material transferred from the dye-donor layer to the slipping layer, as measured by the change in sensitometry under accelerated aging conditions, or the appearance of unwanted dye in the laminate layer, or from the backside of the dye-donor element, for example, a slipping layer, to the dye-donor layer. The use of the beads can result in reduced mottle and improved image quality. The beads can be employed in any amount effective for the intended purpose. In general, good results have been obtained at a coverage of from 0.003 to 0.20 $g/m^2$. Beads suitable for the dye-donor layer can also be used in the slip layer.

The beads in the dye-donor layer can be crosslinked, elastomeric beads. The beads can have a glass transition temperature (Tg) of 45° C. or less, for example, 10° C. or less. The elastomeric beads can be made from an acrylic polymer or copolymer, such as butyl-, ethyl-, propyl-, hexyl-, 2-ethylhexyl-, 2-chloroethyl-, 4-chlorobutyl- or 2-ethoxyethyl-acrylate or methacrylate; acrylic acid; methacrylic acid; hydroxyethyl acrylate; a styrenic copolymer, such as styrene-butadiene, styrene-acrylonitrile-butadiene, styrene-isoprene, or hydrogenated styrene-butadiene; or mixtures thereof. The elastomeric beads can be crosslinked with various crosslinking agents, which can be part of the elastomeric copolymer, such as but not limited to divinylbenzene; ethylene glycol diacrylate; 1,4-cyclohexylene-bis(oxyethyl)dimethacrylate; 1,4-cyclohexylene-bis(oxypropyl) diacrylate; 1,4-cyclohexylene-bis(oxypropyl)dimethacrylate; and ethylene glycol dimethacrylate. The elastomeric beads can have from 1 to 40%, for example, from 5 to 40%, by weight of a crosslinking agent.

The beads in the dye-donor layer can be hard polymeric beads. Suitable beads can include divinylbenzene beads, beads of polystyrene crosslinked with at least 20 wt. % divinylbenzene, and beads of poly(methyl methacrylate) crosslinked with at least 20 wt. % divinylbenzene, ethylene glycol dimethacrylate, 1,4-cyclohexylene-bis(oxyethyl) dimethacrylate, 1,4-cyclohexylene-bis(oxypropyl) dimethacrylate, or other crosslinking monomers known to those familiar with the art.

As noted above, the dye donor elements of the invention are used to form a dye transfer image. Such a process comprises imagewise heating a dye-donor element as described above and transferring a dye image to a dye receiving element to form the dye transfer image.

The dye donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651; 4,695,287; 4,701,439; 4,757,046; 4,743,582; 4,769,360 4,753,922; 4,910,187; 5,374,601, 5,476,943, 5,532,202, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and magenta dye, and the above process steps are sequentially performed for each color to obtain a three-color dye transfer image. Of course, when the process is only performed for a single color, then a monochrome dye transfer image is obtained.

A thermal dye transfer assemblage of the invention comprises (a) a dye-donor element as described above, and (b) a dye-receiving element as described above, the dye receiving element being in a superposed relationship with the dye donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process is repeated. The third color is obtained in the same manner.

The receiver element suitable for use with the dye-donor element described herein can be any receiver element as known to practitioners in the art. For example, the receiver element can include a support having thereon a dye image-receiving layer. The support can be a transparent film. Transparent supports include cellulose derivatives, for example, a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly (butylene terephthalate), and copolymers thereof; polyimides; polyamides; polycarbonates; polystyrene; poly(vinyl alcohol-co-vinlyacetal); polyolefins, such as polyethylene or polypropylene; polysulfones; polyacrylates; polyetherimides; and mixtures thereof. Opaque supports can include plain paper, coated paper, synthetic paper, photographic paper support, melt-extrusion-coated paper, and laminated paper, such as biaxially oriented support laminates. Biaxially oriented support laminates suitable for use as receivers are described in U.S. Pat. Nos. 5,853,965; 5,866,282; 5,874,205; 5,888,643; 5,888,681; 5,888,683; and 5,888,714. Biaxially oriented supports can include a paper base and a biaxially oriented polyolefin sheet, for example, polypropylene, laminated to one or both sides of the paper base. The support can be a reflective paper, for example, baryta-coated paper, white polyester (polyester with white pigment incorporated therein), an ivory paper, a condenser paper, or a synthetic paper, for example, DuPont Tyvek® by E.I. DuPont de Nemours and Company, Wilmington, Del. The support can be employed at any desired thickness, for example, from 10 μm to 1000 μm. Exemplary supports for the dye image-receiving layer are disclosed in commonly assigned U.S. Pat. Nos. 5,244,861 and 5,928,990, and in EP-A-0671281. Other suitable supports as known to practitioners in the art can also be used. According to various embodiments, the support can be a composite or laminate structure comprising a base layer and one or more additional layers. The base layer can comprise more than one material, for example, a combination of one or more of a microvoided layer, a foamed layer, a nonvoided layer, a synthetic paper, a natural paper, and a polymer.

The dye image-receiving layer of the receiver element can be, for example, a polycarbonate, a polyurethane, a polyester, polyvinyl chloride, poly(styrene-co-acrylonitrile), poly(caprolactone), poly(vinyl chloride-co-vinyl acetate), poly(ethylene-co-vinyl acetate), polyvinylacetals such as polyvinylbutyral or polyvinylheptal, polymethacrylates including those described in U.S. Pat. No. 6,361,131, or combinations thereof. The dye image-receiving layer can be coated on the receiver element support in any amount effective for the intended purpose of receiving the dye from the dye-donor layer of the dye-donor element.

For example, the dye image-receiving layer can be coated in an amount of from 1 $g/m^2$ to 5 $g/m^2$. Additional polymeric layers can be present between the support and the dye image-receiving layer. The additional layers can provide coloring, adhesion, antistat properties, act as a dye-barrier, act as a dye mordant layer, or a combination thereof. For example, a polyolefin such as polyethylene or polypropylene can be present. White pigments such as titanium dioxide, zinc oxide, and the like can be added to the polymeric layer to provide reflectivity. A subbing layer optionally can be used over the polymeric layer in order to improve adhesion to the dye image-receiving layer. This can be called an adhesive or tie layer. Exemplary subbing layers are disclosed in U.S. Pat. Nos. 4,748,150, 4,965,238, 4,965,239, and 4,965241. An antistatic layer as known to practitioners in the art can also be used in the receiver element. The receiver element can also include a backing layer. Suitable examples of backing layers include those disclosed in U.S. Pat. Nos. 5,011,814 and 5,096,875.

The dye image-receiving layer, or an overcoat layer thereon, can contain a release agent, for example, a silicone or fluorine based compound, as is conventional in the art. Various exemplary release agents are disclosed, for example, in U.S. Pat. Nos. 4,820,687 and 4,695,286.

The receiver element can also include stick preventative agents, as described for the donor element. According to various embodiments, the receiver element and dye-donor element can include the same stick preventative agent.

The dye image-receiving layer can be formed on the support by any method known to practitioners in the art, including but not limited to printing, solution coating, dip coating, and extrusion coating. Wherein the dye image-receiving layer is extruded, the process can include (a) forming a melt comprising a thermoplastic material; (b) extruding or coextruding the melt as a single-layer film or a layer of a composite (multilayer or laminate) film; and (c) applying the extruded film to the support for the receiver element.

The dye-donor element and receiver element, when placed in superposed relationship such that the dye-donor layer of the dye-donor element is adjacent the dye image-receiving layer of the receiver element, can form a print assembly. An image can be formed by passing the print assembly past a print head, wherein the print head is located on the side of the dye-donor element opposite the receiver element. The print head can apply heat image-wise or patch-wise to the dye-donor element, causing the dyes or laminate in the dye-donor layer to transfer to the dye image-receiving layer of the receiver element.

Thermal print heads that can be used with the print assembly are available commercially and known to practitioners in the art. Exemplary thermal print heads can include, but are not limited to, a Fujitsu Thermal Head (FTP-040 MCSOO1), a TDK Thermal Head F415 HH7-1089, a Rohm Thermal Head KE 2008-F3, a Shinko head (TH300U162P-001), and Toshiba heads (TPH162R1 and TPH207R1A).

EXAMPLES

The invention has been described in detail with particular reference to preferred embodiments thereof, but it will be understood that variations and modifications can be effected within the spirit and scope of the invention.

The purpose of these experiments was to simulate the transfer of thermal dyes during the donor manufacturing process and subsequent shipping processes and to demonstrate how the donor slip layer can influence this transfer process and result in less color contamination and dye contamination of the protective laminate layer.

In these model experiments samples of dye donor elements were prepared using single dyes, and mixtures of dyes, coated on poly(ethylene terephthalate) (PET) support, and separately two examples of slip layer elements featuring the control and inventive slip layer formulations were prepared on PET support. Each dye donor element was then incubated under pressure in contact with the slip layer coatings to allow dye transfer to occur, this is the so-called "1× -retransfer". The contaminated slip layer coatings were then incubated under pressure in contact with coatings of protective laminate to allow dye to transfer from the contaminated slip layer to the laminate, this is the so-called "2× retransfer". The stain in the laminate was then measured and tabulated by subtracting the stain of non-dye coatings incubated in the same manner. The structures of the dyes used in the donor examples are shown below.

Dye 1

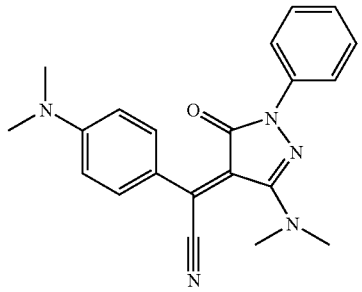

Dye 2

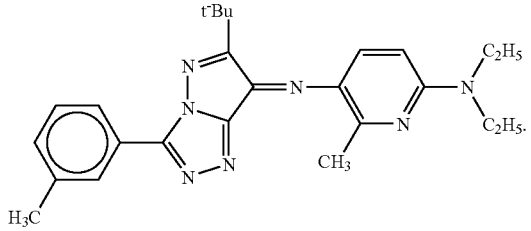

Dye 3

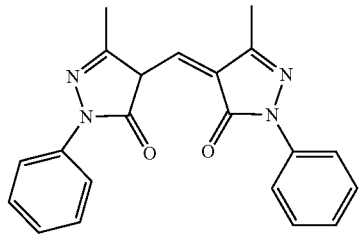

-continued

Dye 4

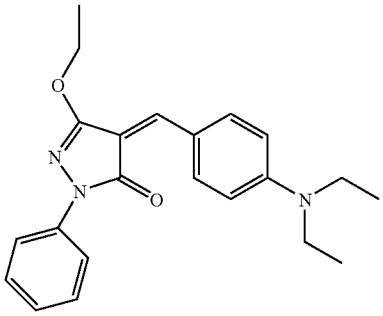

Dye 5

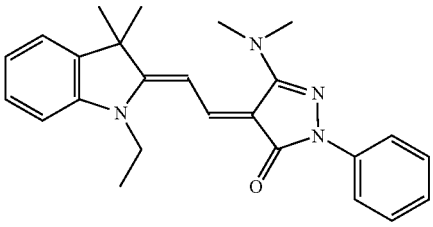

Dye IIIa

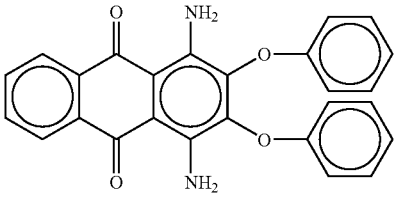

(IIIa)

Description of Dye Layer, Slip Layer and Protective Laminate Coating Preparation Dye Donor Example 1

Dye donor element 1 was prepared by coating the following layers in the order recited on 4.5 micron poly(ethylene terephthalate) support:

(1) a subbing layer of a titanium alkoxide (DuPont Tyzor TBT®) (0.12 g/m$^2$) from n-propyl acetate and n-butyl alcohol solvent mixture, and (2) a dye layer containing the magenta Dye 1 (0.17 g/m$^2$), 2 micron di-vinyl benzene beads (0.004 g/m$^2$), Paraplex G25 from C.P. Hall Co. Chicago, Ill., USA (0.05 g/m$^2$) in a cellulose acetate propionate (CAP) binder (Eastman Chemical Type 482-20) (0.25 g/m$^2$) coated from a toluene, methanol and cyclopentanone solvent mixture.

Dye Donor Example 2

Dye Donor Element 2 was prepared in the same manner except that magenta Dye 1 was replaced by magenta Dye 2 at 0.17 g/m$^2$.

Dye Donor Examples 3-5

Dye Donor Elements 3-5 were prepared in the same manner as Example 1, except that magenta dye 1 was replaced by yellow dyes 3, 4, and 5 respectively coated at 0.13 g/m$^2$ with the CAP binder at 0.21 g/m$^2$.

Dye Donor Example 6

Dye Donor Example 6 was prepared in the same manner as Example 1 except that Dye 1 was replaced by a mixture of magenta dyes; magenta dye 1 at 0.046 g/m$^2$, magenta dye 2 at 0.14 g/m$^2$, and magenta dye IIIa at 0.046 g/m$^2$. The binder was changed to Ethyl Cellulose (Aqualon N50, Hercules Chemical, Wilmington, Del.) at 0.22 g/m$^2$.

Dye Donor Example 7

Dye Donor Example 7 was prepared in the same manner as Example 1 except that magenta Dye 1 was replaced by a mixture of yellow dyes; yellow dye 3 at 0.032 g/m$^2$, yellow dye 4 at 0.097 g/m$^2$, and yellow dye 5 at 0.032 g/m$^2$. The binder was changed to Ethyl Cellulose (Aqualon N50, Hercules Chemical, Wilmington, Del.) at 0.22 g/m$^2$.

Slip Layer Example 1

Control

A dye donor slipping layer side was prepared by coating the following layers in the order recited on 4.5 micron poly (ethylene terephthalate) support:

a subbing layer of a titanium alkoxide (DuPont Tyzor TBT®) (0.12 g/m$^2$) from n-propyl acetate and n-butyl alcohol solvent mixture, and a slipping layer of polymers listed below in a polyvinyl acetal binder (Sekisui KS1) (0.4 g/m$^2$) coated out of a 3-pentanone and methanol solvent mixture. P-toluenesulfonic acid was also added (0.0003 g/m$^2$).

The slipping-layer polymers used in the control example were the control polymers listed below:

Control polymers ("CP"):

CP1: DMS-A31, aminopolydimethylsiloxane, from Gelest. (Tullytown, Pa.), coated at 0.01 g/m$^2$.

CP2: Candelilla Wax Slurry, from Eastman Kodak Company (Rochester, N.Y.), coated at 0.02 g/m$^2$ Slip Layer Example 2

Invention

A dye donor slipping layer side was prepared by coating the following layers in the order recited on 4.5 micron poly (ethylene terephthalate) support:

a subbing layer of a titanium alkoxide (DuPont Tyzor TBT®) (0.12 g/m$^2$) from n-propyl acetate and n-butyl alcohol solvent mixture, and a slipping layer of consisting of the inventive polymers listed below in a polyvinyl acetal binder (Sekisui KS 1) (0.4 g/m$^2$) coated out of a toluene, methanol, and cyclopentanone solvent mixture.

Invention polymers ("IP"):

IP1: Polywax 400®, ethene homopolymer, from Baker-Petrolite Polymers (Sugar Land, Tex.) coated at 0.022 g/m$^2$ IP2: Vybar 103®, polyalphaolefin, from Baker-Petrolite Polymers (Sugar Land, Tex.) coated at 0.022 g/m$^2$.

IP3: Ceremer 1608®, reaction products of maleic anhydride and mono-isopropyl maleate, from Baker-Petrolite Polymers (Sugar Land, Tex.) coated at 0.022 g/m$^2$ Protective Laminate Coating A protective laminate coating for the model experiments (PL1) was prepared by coating the following layer on 4.5 micron poly(ethylene terephthalate) support, using a mixture of ketone solvents:

Binder: poly(vinyl acetal) (Sekisui Co. KS-10), 0.63 g/m$^2$ colloidal silica IPA-ST (Nissan Chemical Co.), 0.46 g/m$^2$ Beads: 4 micron divinylbenzene beads, 0.11 g/m$^2$ UV absorber: Tinuvin 460 (Ciba), 0.11 g/m$^2$ Preparation of Retransfer Samples 1× Retransfer The dye containing side of a 7.6 cm×12.7 cm piece of donor prepared in Dye Donor Example 1 was placed in contact with the slip layer side of a 7.6 cm×12.7 cm slip layer prepared in Slip Layer Example 1. To ensure uniform pressure this combination (i.e., one packet) was centered between two 7.6 cm×10.2 cm sheets of Kodak Xtralife receiver with the dye receiving layers of the receiver sheets facing towards the packet. The entire combination was stapled along the margin of each side of receiver.

This procedure was repeated for Dye Donor Examples 2-7 placed in contact with Slip Layer Example 1.

All seven prepared samples were evenly stacked together and 175 psi pressure was applied to the sample stack via a spring clamp apparatus. The spring clamp containing the prepared samples was placed in an environmentally controlled chamber set at 23° C./50% RH for fourteen days.

An identical procedure was followed to produce a second set of samples this time using the Inventive Polymers of Slip Layer Example 2 in the slip layer. These were incubated as described above.

The sample composition is summarized in Table 1 below.

TABLE 1

| Sample No. | Dye Donor | Dye | Slip Layer |
|---|---|---|---|
| 1 | 1 | Magenta dye 1 | Control Example 1 |
| 2 | 2 | Magenta dye 2 | " |
| 3 | 3 | Yellow dye 3 | " |
| 4 | 4 | Yellow dye 4 | " |
| 5 | 5 | Yellow dye 5 | " |
| 6 | 1 | Magenta dye 1 | Inventive Example 2 |
| 7 | 2 | Magenta dye 2 | " |
| 8 | 3 | Yellow dye 3 | " |
| 9 | 4 | Yellow dye 4 | " |
| 10 | 5 | Yellow dye 5 | " |
| 11 | 6 | Magenta Dyes, 1, 2, and IIIa | Control Example 1 |
| 12 | 7 | Yellow Dyes, 3, 4, and 5 | Control Example 1 |
| 13 | 6 | Magenta Dyes, 1, 2, and IIIa | Inventive Example 2 |
| 14 | 7 | Yellow Dyes, 3, 4, and 5 | Inventive Example 2 |

2× Retransfer

The "1× Retransfer" samples were removed from the spring clamp at the end of the incubation period. The donors sheets were discarded and the contaminated slip-containing layers were placed on center against a 7.6 cm×12.7 cm sample of the protective laminate coating, PL1, described above, and placed between two new receiver sheets as described above for the 1× Retransfer sample preparation procedure. Each resulting sample was stapled once along each margin of receiver.

All fourteen prepared samples were evenly stacked together and 175 psi pressure was applied to the sample stack via a spring clamp apparatus. The spring clamp apparatus containing the prepared samples was placed in an environmentally controlled chamber 45° C./50% RH for five days.

Preparation of Reference Laminate Layer Samples

Two reference protective laminate layer samples were also prepared to provide non-dye-containing controls for the experiment, one using the Control Slip Layer of Example 1, and the other using the Inventive Slip layer of Example 2.

For example, to produce the laminate sample with the control slip layer, a 7.6 cm×12.7 cm Control Slip Layer 1 sample was matched with a second 7.6 cm×12.7 cm Slip Layer 1 sample in the 1× Retransfer Sample Preparation described above. After incubation, one of the resulting slip layers was then matched with a laminate layer sample as in the 2× Retransfer Sample Preparation procedure, and incubated.

Stain Measurement After Incubation

At the end of the 2× Retransfer incubation period the laminate layer samples were separated from the slip layer samples. Each laminate layer sample was placed face down onto the dye receiving layer of a sheet Kodak Xtralife Thermal receiver. L*, a*, and b* calorimetric data were collected using a Gretag Macbeth SpectroScan scanning through the backside of the laminate layer sample. Each sample was read four times.

The average was taken for the reference laminate $L^*_{lam}$. The reference laminate, $L^*_{lam}$, average was subtracted from each individual laminate with dye sample $L^*_{dye}$. This process was repeated for a* and b* measurements, to produce values for $a^*_{dye}$, $a^*_{lam}$, $b^*_{dye}$ and $b^*_{lam}$. The difference between the color of the reference laminate, $L^*_{lam}$, and the laminate with dye contamination, $L^*_{dye}$, was calculated using the Delta E metric.

Delta E (CIE 1976) was computed using the following convention:

$$\text{Delta E (CIE 1976)}=[(L^*_{dye}-L^*_{lam})^2+(a^*_{dye}-a^*_{lam})^2+(b^*_{dye}-b^*_{lam})^2]^{1/2}$$

Averages and standard deviations were calculated. Results are summarized in Table 2.

Smaller Delta E values indicate lower stain values.

TABLE 2

2X Retransfer
Average Delta $E_{1976}$ by Dye and Slip Type

| Table 1 Dye Donor | Table 1 Dye | Slip Layer | Delta $E_{1976}$ Avg. | Delta $E_{1976}$ Std. Dev. |
|---|---|---|---|---|
| 1 | 1 | Control 1 | 0.68 | 0.09 |
| | | Invention 2 | 0.43 | 0.09 |
| 2 | 2 | Control 1 | 2.01 | 0.14 |
| | | Invention 2 | 1.17 | 0.11 |
| 3 | 3 | Control 1 | 0.94 | 0.44 |
| | | Invention 2 | 0.32 | 0.06 |
| 4 | 4 | Control 1 | 0.83 | 0.13 |
| | | Invention 2 | 0.72 | 0.09 |
| 5 | 5 | Control 1 | 0.97 | 0.31 |
| | | Invention 2 | 0.53 | 0.06 |
| 6 | 1, 2, IIIa | Control 1 | 2.85 | 0.08 |
| | | Invention 2 | 1.94 | 0.09 |
| 7 | 3, 4, 5 | Control 1 | 2.58 | 0.17 |
| | | Invention 2 | 2.19 | 0.06 |

The results clearly show that the inventive slip layer of this invention produces lower Delta E values (lower stain) after the 2× Retransfer test, with less contamination of the laminate with dye. The improvement in the level of dye stain shown by use of the inventive slip layer formulation ranges from 13% to 66%.

The invention claimed is:

1. A dye-donor element for thermal dye transfer comprising a support having on one side a dye layer and on a second side a slipping layer, wherein the slipping layer comprises a first wax comprising a polymer derived from a polyolefin and an ethylenically unsaturated carboxylic acid or ester or anhydride thereof, and at least one other wax and wherein said dye layer comprises at least a magenta dye of the following structure I:

(I)

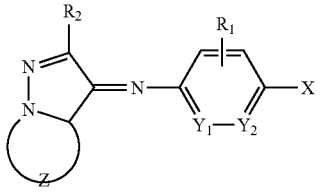

wherein X is a $NR_3R_4$ group or a hydroxyl group, wherein $R_3$ and $R_4$ may be same or different and are independently selected from an alkyl, alkenyl, aryl, aralkyl, or cycloalkyl group; $Y_1$ and $Y_2$ each independently are selected from a carbon atom or a nitrogen atom, provided that one of $Y_1$ and $Y_2$ is a nitrogen atom; Z is an atomic group necessary to form a 5- or 6-membered nitrogen-containing heterocyclic ring which may be condensed with another ring; and $R_1$ and $R_2$ are each independently selected from a hydrogen atom, halogen atom, alkyl, alkenyl, alkoxy, alkylamino, acetamido, sulfonamide, aryl, aralkyl, or cycloalkyl group, wherein said dye donor element has reduced 2× retransfer.

2. The dye-donor element of claim 1 wherein said structure I is as follows:

(Ia)

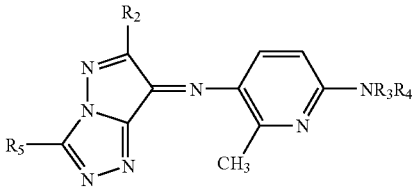

wherein $R_3$ and $R_4$ can be the same or different and are independently selected from an alkyl and an alkenyl; $R_2$ can be a $C_{1-6}$ alkyl; and $R_5$ can be a $C_{1-10}$ alkyl group, a $C_{5-7}$ cycloalkyl group, or a $C_{6-10}$ aryl group.

3. The dye-donor element of claim 2 wherein said structure Ia is as follows:

(Ib)

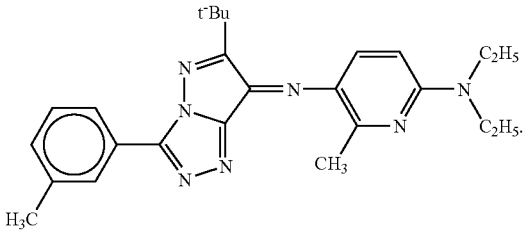

4. The dye-donor element of claim 1 wherein said dye layer further comprises a second magenta dye of the structure II:

(II)

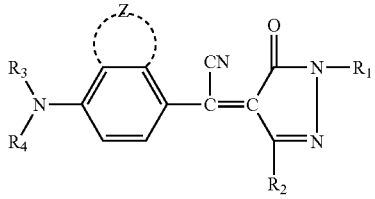

wherein:

$R_1$ represents an alkyl group having from 1 to 10 carbon atoms, a cycloalkyl group having from 5 to 7 carbon atoms, or an aryl group having from 6 to 10 carbon atoms;

$R_2$ represents an alkoxy group having from 1 to 10 carbon atoms, an aryloxy group having from 6 to 10 carbon atoms, naphthoxy, $NHR_5$, $NR_5$, or $R_6$;

$R_3$ and $R_4$ are each independently $R_1$, or either or both of $R_3$ and $R_4$ can be joined to the carbon atom of the aromatic ring at a position ortho to the position of attachment of the anilino nitrogen to form a 5- or 6-membered ring, or $R_3$ and $R_4$ can be joined together to form a 5- or 6-membered heterocyclic ring with the nitrogen to which they are attached;

$R_5$ and $R_6$ each independently represents an alkyl group having from 1 to 10 carbon atoms, a cycloalkyl group having from 5 to 7 carbon atoms, or an aryl group having from 6 to 10 carbon atoms, or $R_5$ and $R_6$ may be joined together to form, along with the nitrogen to which they are attached, a 5- or 6-membered heterocyclic ring; and Z represents hydrogen or the atoms necessary to complete a 5- or 6-membered ring.

5. The dye-donor element of claim 4 wherein structure II is as follows:

(IIa)

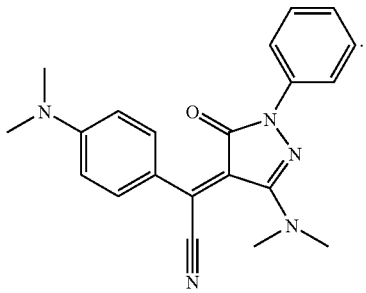

6. The dye-donor element of claim 4 wherein said dye layer further comprises a third magenta dye of the following structure III:

(III)

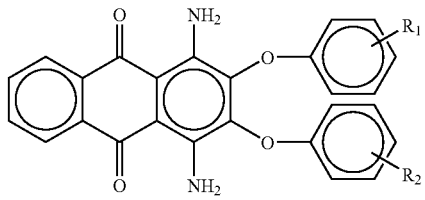

wherein $R_1$ and $R_2$ are each independently selected from hydrogen, hydroxyl, halogen, $C_{1-4}$ alkyl, or $C_{1-4}$ alkoxy.

7. The dye-donor element of claim 6 wherein said structure III is as follows:

(IIIa)

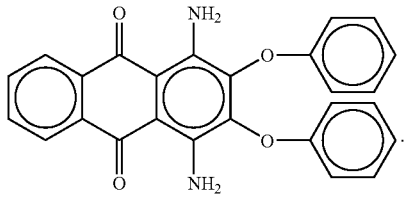

8. The dye-donor element of claim 4 wherein said dye layer further comprises a third magenta dye of the following structure IV:

(IV)

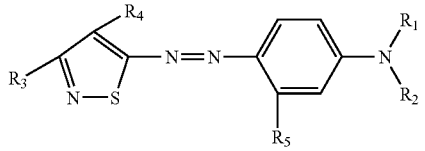

wherein:

$R_1$ and $R_2$ are each independently hydrogen, $C_{1-6}$ alkyl or allyl, $C_{5-7}$ cycloalkyl, $C_{5-10}$ aryl, or $R_1$ and $R_2$ can be taken together to form a 5- or 6-membered heterocyclic ring which can include the nitrogen to which $R_1$ or $R_2$ is attached, and either carbon atom ortho to the carbon attached to the nitrogen atom;

$R_3$ is a hydrogen, $C_{1-6}$ alkyl, $C_{5-10}$ aryl, alkylthio, or halogen;

$R_4$ is cyano, thiocyanato, alkylthio, or alkoxycarbonyl; and $R_5$ is a $C_{1-6}$ alkyl, a $C_{5-10}$ aryl, or NHA, where A is an acyl or sulfonyl radical.

9. The dye-donor element of claim 8 wherein said structure IV is as follows:

(IVa)

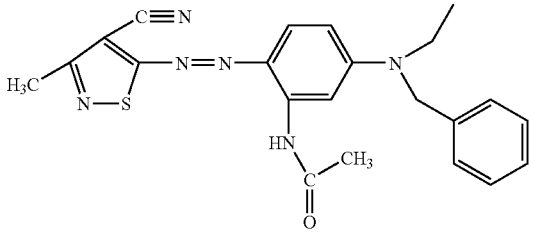

or (IVb)

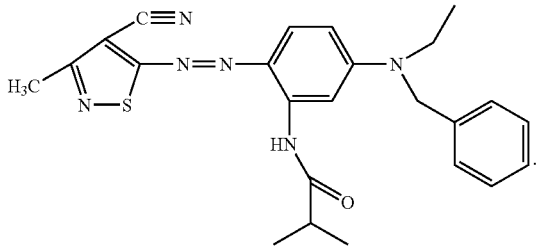

10. The dye-donor element of claim 1 wherein said dye donor element further comprises a yellow dye-donor patch comprising at least one bis-pyrazolone-methine dye and at least one other pyrazolone-methine dye, and a cyan dye-donor patch comprising at least one indoaniline cyan dye.

11. The element of claim 1 wherein said dye layer further comprises a polymeric binder, wherein said polymeric binder is a cellulose ether or ester.

12. The element of claim 1 wherein the other wax is selected from the group consisting of a mineral wax, a vegetable wax, an animal wax or a synthetic wax that is a saturated or unsaturated hydrocarbon polymer.

13. The element of claim 1 wherein the other wax is a branched hydrocarbon with a number average molecular weight of no more than 10,000 and a melting point or softening point of no more than 120° C.

14. The element of claim 13 wherein the branched hydrocarbon is a poly-α-olefin wax.

15. The element of claim 13 wherein the branched hydrocarbon comprises a polymerized alpha-olefin prepared from alpha-olefins having the formula:

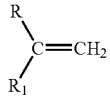

where R is $C_6$ to $C_{50}$ alkyl and $R^1$ is hydrogen or $C_6$ to $C_{50}$ alkyl, wherein the polymerized alpha-olefin has a number average molecular weight of 500 to 5000.

16. The dye-donor element of claim 1 wherein said slipping layer comprises at least three different waxes, the polymer derived from the polyolefin and the ethylenically unsaturated carboxylic acid or ester or anhydride thereof, a highly branched alpha-olefin polymer, and at least one other wax.

17. The element of claim 16 wherein the polyolefin is derived from an α-olefin containing between two to eight carbon atoms.

18. The element of claim 17 wherein the alpha-olefin is ethylene and/or propylene.

19. The element of claim 16 wherein the ethylenically unsaturated carboxylic acids are those having between 3 to 12 carbon atoms.

20. The element of claim 16 wherein the ethylenically unsaturated carboxylic acid, ester or anhydride is maleic acid, ethylmaleic acid, propylmaleic acid, isopropyl maleic acid, fumaric acid, methylenemalonic acid, glutaconic acid, itaconic acid, methylitaconic acid, mesacomic acid, citraconic acid, or a mixture thereof, as well as corresponding esters, anhydrides or mixtures of such acids, esters and anhydrides.

21. The element of claim 16 wherein the polymer is of the structural formula:

(VII)

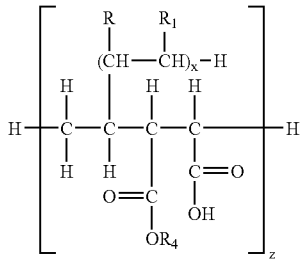

wherein R and $R_1$ individually represent hydrogen or a C1 to C10 alkyl group; x is 9 to 75; $R_4$ is a hydrogen or a $C_1$-$C_3$ alkyl group; and z is from 5 to 20.

22. The element of claim 16 wherein the polymer is an alpha-olefin maleic anhydride copolymer.

23. The element of claim 22 wherein the polymer is a maleic anhydride polyethylene graft copolymer.

24. The element of claim 16 wherein the polymer is a copolymer of an α-olefin and isopropyl maleate.

25. The element of claim 16 wherein the at least one other wax is a substantially linear wax selected from the group consisting of microcrystalline wax, carnauba wax, petronable wax, paraffin wax, candelilla wax and low molecular weight polyethylene.

26. The element of claim 16 wherein the slipping layer comprises 10 to 80 percent by weight of the polymer derived from a polyolefin and an ethylenically unsaturated carboxylic acid or ester or anhydride thereof; 10 to 80 percent by weight of the highly branched alpha-olefin polymer, and 10 to 80 percent by weight of the at least one other wax comprising a substantially linear wax.

27. The element of claim 16 wherein the at least one other wax is a substantially linear wax comprising a saturated hydrocarbon polymer.

28. The element of claim 16 wherein the at least one other wax is a substantially linear wax comprising a linear low molecular weight polyethylene.

29. The element of claim 16 wherein the branched alpha-olefin has a number average molecular weight of no more than 10,000 and a melting point or softening point of no more than 120° C.

30. The element of claim 29 wherein the branched alpha-olefin comprises a polymerized alpha-olefin prepared from alpha-olefins having the formula:

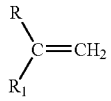

where R is $C_6$ to $C_{50}$ alkyl and $R^1$ is hydrogen or $C_6$ to $C_{50}$ alkyl, wherein the polymerized alpha-olefin has a number average molecular weight of 500 to 5000.

31. A dye-donor element for thermal dye transfer comprising a support having on one side a dye layer and on a second side a slipping layer, wherein the slipping layer comprises a first wax comprising a polymer derived from a polyolefin and an ethylenically unsaturated carboxylic acid or ester or anhydride thereof, and at least one other wax and wherein said dye layer comprises at least a yellow dye of the following structure X:

(X)

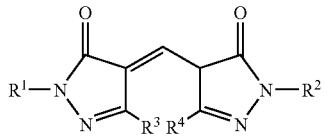

wherein $R^1$ and $R^2$ can be respectively independently selected and are a lower alkyl group which may be substituted, a lower alkenyl group which may be substituted or an aryl group which may be substituted;

$R^3$ and $R^4$ can be respectively independently selected and are a lower alkyl group which may be substituted, a dialkylamino group, a —$COOR^5$ group or a —$CONR^6R^7$ group, in which $R^5$ is a lower alkyl group which may be substituted, a lower alkenyl group which may be substituted or an aryl group which may be substituted and $R^6$ and $R^7$ can be respectively independently selected and are a hydrogen atom, a lower alkyl group which may be substituted, a lower alkenyl group which may be substituted or an aryl group which may be substituted;

or at least a yellow dye of the following structure XI:

(XI)

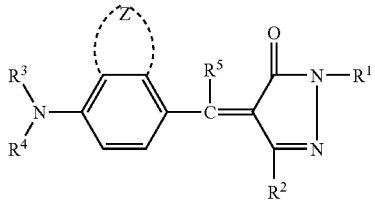

wherein $R^1$ represents a substituted or unsubstituted alkyl group having from 1 to 10 carbon atoms; a cycloalkyl group having from 5 to 7 carbon atoms or an aryl group having from 6 to 10 carbon atoms;

$R^2$ represents a substituted or unsubstituted alkoxy group having from 1 to 10 carbon atoms; a substituted or unsubstituted aryloxy group having from 6 to 10 carbon atoms; $NHR^6$; $NR^6R^7$ or the atoms necessary to complete a 6-membered ring fused to the benzene ring;

$R^3$ and $R^4$ each represents $R^1$; or $R^3$ and $R^4$ can be joined together to form, along with the nitrogen to which they are attached, a 5- or 6-membered hetercyclic ring;

$R^5$ represents hydrogen; halogen; carbamoyl; alkoxycarbonyl; acyl; a substituted or unsubstituted alkyl or alkoxy group having from 1 to 10 carbon atoms; a cycloalkyl group having from 5 to 7 carbon atoms; an aryl group having from 6 to 10 carbon atoms; or a dialkylamino group;

$R^6$ and $R^7$ each independently represents a substituted or unsubstituted alkyl group having from 1 to 10 carbon atoms; a cycloalkyl group having from 5 to 7 carbon atoms or an aryl group having from 6 to 10 carbon atoms; $R^6$ and $R^7$ may be joined together to form, along with the nitrogen to which they are attached, a 5- or 6-membered heterocyclic ring; and Z represents hydrogen or the atoms necessary to complete a 5- or 6-membered ring;

or at least a yellow dye of the following structure XII:

(XII)

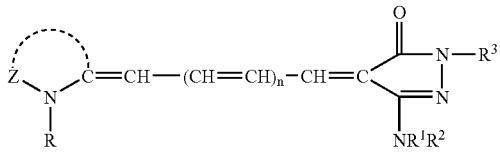

wherein:

R represents a substituted or unsubstituted alkyl group of from 1 to 6 carbon atoms or a substituted or unsubstituted aryl group of from 6 to 10 carbon atoms;

$R^1$ and $R^2$ each independently represents hydrogen, with the proviso that only one of $R^1$ and $R^2$ may be hydrogen at the same time; a substituted or unsubstituted alkyl group of from 1 to 6 carbon atoms or a substituted or unsubstituted aryl group of from 6 to 10 carbon atoms; or $R^1$ and $R^2$ may be combined together with the nitrogen to which they are attached to form a heterocyclic ring system;

$R^3$ is R;

n represents 0 or 1; and

Z represents the atoms necessary to complete a 5- or 6-membered substituted or unsubstituted heterocyclic ring;

or at least a yellow dye of the following structure XIII:

(XIII)

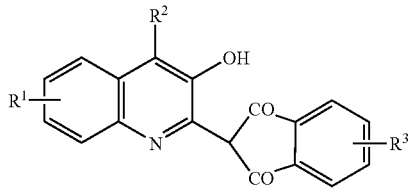

wherein:

$R_1$ is an alkyl group having 1 to 8 carbon atoms or cycloalkyl group;

$R_2$ is a hydrogen atom, halogen atom, alkoxy group which may be substituted, alkylthio group which may be substituted or arylthio group which may be substituted;

$R_3$ is a branched alkyl group having 3 to 5 carbon atoms, an O-substituted oxycarbonyl group, an N-substituted aminocarbonyl group in which the N-substituted group may form a ring, or a substituted or unsubstituted heterocyclic ring having two or more hetero atoms of one or more kinds selected from the group consisting of a nitrogen atom, oxygen atom and sulfur atom; and wherein said dye donor element has reduced 2× retransfer.

32. The element of claim 31 wherein the dye of structure X specifically has the following structure Xa:

(Xa)

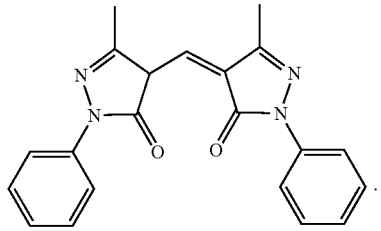

33. The element of claim 31 wherein the dye of structure XI specifically has the following structure XIa:

(XIa)

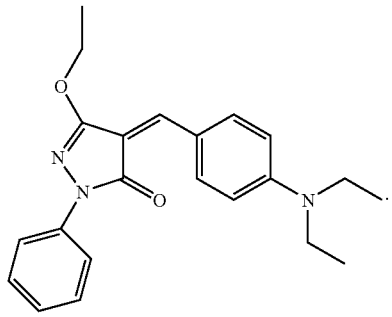

34. The element of claim 31 wherein the dye of structure XII specifically has the following structure XIIa:

(XIIa)

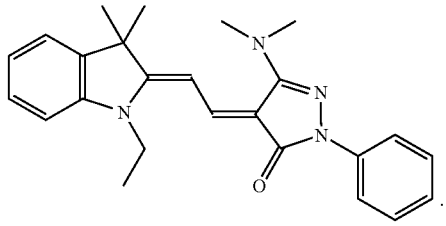

35. The element of claim 31 wherein the dye of structure XIII specifically has the following structure XIIIa:

(XIIIa)

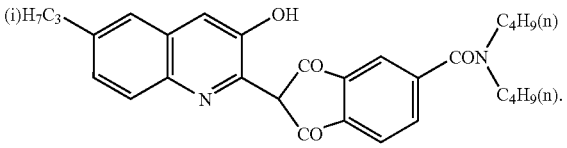

36. The element of claim 31 wherein said dye donor element further comprises a magenta dye-donor patch comprising at least one pyrazolone-triazol dye and at least one alpha-cyano arylidene pyrazolone dye, and a cyan dye-donor patch comprising at least one indoaniline cyan dye.

37. The element of claim 31 wherein said dye layer further comprises a polymeric binder, wherein said polymeric binder is a cellulose ether or ester.

38. The element of claim 31 wherein the other wax is selected from the group consisting of a mineral wax, a vegetable wax, an animal wax or a synthetic wax that is a saturated or unsaturated hydrocarbon polymer.

39. The element of claim 31 wherein the other wax is a branched hydrocarbon with a number average molecular weight of no more than 10,000 and a melting point or softening point of no more than 120° C.

40. The element of claim 31 wherein said slipping layer comprises at least three different waxes, the polymer derived from the polyolefin and the ethylenically unsaturated carboxylic acid or ester or anhydride thereof, a highly branched alpha-olefin polymer, and at least one other wax.

41. A dye-donor element for thermal dye transfer comprising a support having on one side a dye layer and on a second side a slipping layer, wherein the slipping layer comprises a first wax comprising a polymer derived from a polyolefin and an ethylenically unsaturated carboxylic acid or ester or anhydride thereof, and at least one other wax and wherein said dye layer comprises at least a cyan dye of the following structure XX:

(XX)

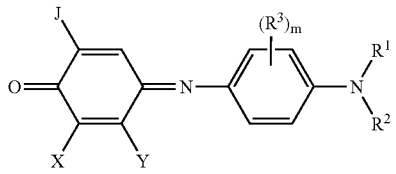

wherein:

$R^1$ and $R^2$ each independently represents hydrogen; an alkyl group having from 1 to 6 carbon atoms; a cycloalkyl group having from 5 to 7 carbon atoms; allyl; or such alkyl, cycloalkyl or allyl groups substituted with one or more groups;

each $R^3$ independently represents hydrogen, substituted or unsubstituted alkyl, cycloalkyl or allyl as described above for $R^1$ and $R^2$; alkoxy, aryloxy, halogen, thiocyano, acylamido, ureido, alkylsulfonamido, arylsulfonamido, alkylthio, arylthio or trifluoromethyl; or any two of $R^3$ may be combined together to form a 5- or 6-membered carbocyclic or heterocyclic ring; or one or two of $R^3$ may be combined with either or both of $R^1$ and $R^2$ to complete a 5- to 7-membered ring;

m is an integer of from 0 to 4;

X represents hydrogen, halogen or may be combined together with Y to represent the atoms necessary to complete a 6-membered aromatic ring to form a fused bicyclic quinoneimine;

J represents $NHCOR^4$, $NHCO_2R^4$, $NHCONHR^4$ or $NHSO_2R^4$; and with the proviso that when X is combined with Y, then J represents $CONHR^4$, $SO_2NHR^4$, CN, $SO_2R^4$ or SCN, in which case, however, $R^4$ cannot be hydrogen;

$R^4$ is the same as $R^1$ or represents an aryl group having from 6 to 10 carbon atoms; a hetaryl group having from 5 to 10 atoms; or such aryl or hetaryl groups substituted with one or more groups such as are listed above for $R^1$ and $R^2$; and Y is the same as $R^4$, or acylamino or may be combined together with X; and wherein the dye donor element has reduced 2× retransfer.

42. The element of claim 41 wherein said cycloalkyl or allyl groups are substituted with one or more groups selected from the group consisting of alkyl, aryl, alkoxy, aryloxy, amino, halogen, nitro, cyano, thiocyano, hydroxy, acyloxy, acyl, alkoxycarbonyl, aminocarbonyl, alkoxycarbonyloxy, carbamoyloxy, acylamido, ureido, imido, alkylsulfonyl, arylsulfonyl, alkylsulfonamido, arylsulfonamido, alkylthio, arylthio, trifluoromethyl, methyl, ethyl, propyl, isopropyl, butyl, pentyl, hexyl, methoxyethyl, benzyl, 2-methanesulfonamidoethyl, 2-hydroxyethyl, 2-cyanoethyl, methoxycarbonylmethyl, cyclohexyl, cyclopentyl, phenyl, pyridyl, naphthyl, thienyl, pyrazolyl, p-tolyl, p-chlorophenyl, m-(N-methyl-sulfamoyl) phenylmethyl, methylthio, butylthio, benzylthio, methanesulfonyl, pentanesulfonyl, methoxy, ethoxy, 2-methane-sulfonamidoethyl, 2-hydroxyethyl, 2-cyanoethyl, methoxy-carbonyl-methyl, imidazolyl, naphthyloxy, furyl, p-tolylsulfonyl, p-chlorophenylthio, m-(N-methyl sulfamoyl)phenoxy, ethoxycarbonyl, methoxyethoxycarbonyl, phenoxycarbonyl, acetyl, benzoyl, N,N-dimethylcarbamoyl, dimethylamino, morpholino, anilino, and pyrrolidino.

43. The element of claim 41 wherein said fused bicyclic quinoneimine is a naphthoquinoneimine.

44. The element of claim 41 wherein said dye donor element further comprises a yellow dye-donor patch comprising at least one bis-pyrazolone-methine dye and at least one other pyrazolone-methine dye, and a magenta dye-donor patch comprising at least one pyrazolone-triazol dye and at least one alpha-cyano arylidene pyrazolone dye.

45. The element of claim 41 wherein said dye layer further comprises a polymeric binder, wherein said polymeric binder is a cellulose ether or ester.

46. The element of claim 41 wherein the other wax is selected from the group consisting of a mineral wax, a vegetable wax, an animal wax or a synthetic wax that is a saturated or unsaturated hydrocarbon polymer.

47. The element of claim 41 wherein the other wax is a branched hydrocarbon with a number average molecular weight of no more than 10,000 and a melting point or softening point of no more than 120° C.

48. The dye-donor element of claim 41 wherein said slipping layer comprises at least three different waxes, the polymer derived from the polyolefin and the ethylenically unsaturated carboxylic acid or ester or anhydride thereof, a highly branched alpha-olefin polymer, and at least one other wax.

* * * * *